United States Patent [19]

Reich

[11] 3,937,161

[45] Feb. 10, 1976

[54] EMBROIDERY MACHINE

[76] Inventor: Rudolf Reich, An der Ringstr. 6, 545, Neuwied, Germany

[22] Filed: July 3, 1974

[21] Appl. No.: 485,463

[30] Foreign Application Priority Data

July 5, 1973 Germany ..... 2334134
Jan. 23, 1974 Germany ..... 2403167

[52] U.S. Cl. ..... 112/83
[51] Int. Cl.[2] ..... D05C 3/04
[58] Field of Search ..... 112/83, 78, 84, 93, 94

[56] References Cited

UNITED STATES PATENTS

| | | | |
|---|---|---|---|
| 1,126,879 | 2/1915 | Schoenfeld | 112/93 |
| 1,162,009 | 11/1915 | Zahn | 112/83 |
| 2,070,914 | 2/1937 | Neubert et al. | 112/83 |
| 2,080,735 | 5/1937 | Neubert et al. | 112/83 |
| 3,125,045 | 3/1964 | Moise | 112/83 |
| 3,177,834 | 4/1965 | Urscheler | 112/83 |
| 3,680,505 | 8/1972 | Reich | 112/83 |

*Primary Examiner*—Alfred R. Guest
*Attorney, Agent, or Firm*—Michael P. Breston

[57] ABSTRACT

The invention concerns an embroidery machine, especially a surface embroidery machine, with embroidery heads, which accommodate, on the needle side, embroidery station elements, such as embroidery needles, piercers, fabric pressers, yarn catchers, front yard knives, etc., which are associated with an embroidery station and which can be adjusted vertically and horizontally in any required manner over the vertical extent of the embroidery field.

33 Claims, 36 Drawing Figures

C-D

F 9
3
10
E 3
30
46
45
44
A-B
27
29
41
40
42

"A"

Fig.32
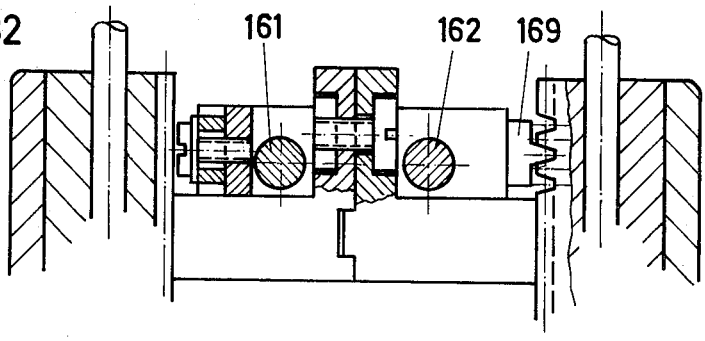
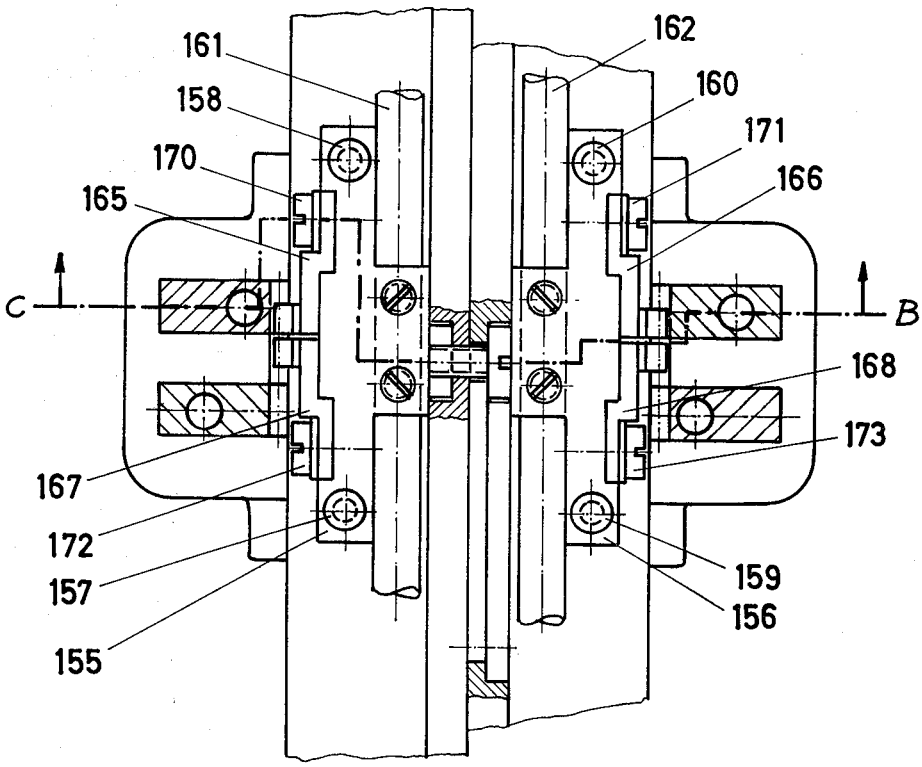
Fig.31

EMBROIDERY MACHINE

BACKGROUND OF THE INVENTION

Known linear embroidery machines make it possible to produce a wide variety of patterns. By means of the repeat color pattern changing automatic systems they can couple and decouple embroidery stations in any required manner especially in order to embroider colored patterns. The disadvantages of the known linear embroidery machines, however, are that their technical equipment is extraordinarily elaborate so that the costs associated with the latter and the space requirements cannot be satisfied in many instances, and that the performance of these machines is relatively limited with respect to the output as well as with respect to production of new designs.

A mono embroidery machine of the abovementioned kind is already known U.S. Pat. No. 3,680,545, in which the embroidery tools associated with an embroidery station are arranged so that they can be adjusted, by means of a drive shaft which covers the whole vertical height of the embroidery field, in the vertical and horizontal directions and which are pushed in an enclosed housing or in an embroidery head above each other on a drive shaft which passes through the housing or through the embroidery head and which can be adjusted in any required manner steplessly in the height for the purpose of varying the repeat depending on the embroidered pattern. Individual or mono embroidery heads are pushed on the drive shaft for this purpose. The disadvantages of this arrangement are that a needle interval, which has once been set between vertically superposed needles, remains fixed, the embroidery work which is being produced can be observed only poorly or not at all, no means are available for reaching by hand to the embroidery fabric and long changeover times are necessary which are associated with a high production loss. Moreover, it is not possible to use these mono embroidery heads as means for creating patterns or to use these heads as means for forming of embroidery patterns in relation to each other within an overall embroidery field.

A double or duo embroidery head of a drive shaft group to eliminate these disadvantages and to simplify and make cheaper the drive of the embroidery heads has already been proposed: this arrangement considerably increases the pattern creating possibilities by staggering the embroidery heads of a double embroidery head in the vertical and horizontal direction and by decoupling of some embroidery heads. However, neither the mono nor the duo embroidery heads separately make it possible to obtain simultaneously a staggered as well as linear arrangement of embroidery heads and the technical total outlay for separate components is relatively high; moreover, the coefficient of friction on the deflecting positions is very high, the space requirement for application of embroidery heads of this kind is also relatively high so that, in order to restrict the claim on space, the fitting of the head must be very compactly carried out and this does not make possible observation and access to the embroidery fabric. Furthermore, the mounting possibilities of mono as well as duo heads are unfavorable because the head must be pushed over the shaft; for this reason an undesirable height increase also occurs. A further decisive disadvantage of the mono or duo embroidery heads is the very severely restricted scope in varying the patterns, either in a staggered or linear manner. Finally, the manufacturing and fitting costs for embroidery machines with such mono or duo heads are also very high.

Since needles and piercers in the embroidery process do not carry out their functions simultaneously and they are effective successively after each other in the embroidery process, it therefore appears feasible to drive needles and piercers by a common drive if it is possible to design this drive in such a manner that the needles and piercers can be actuated in a staggered order in time and hence the needle and piercer movements can be carried out separately in time. Furthermore, the yarn cutting arrangement does not function when embroidering or piercing is carried out and, alternatively, the needle and piercer are out of action when the yard cutting arrangement is effective, so that the three functions, i.e. embroidering, piercing, yarn cutting are never carried out simultaneously but always successively in time, one after the other.

In piercing drives, which were known previously or proposed, all piercers have carried out the same working process so that the piercing effects could be used only to a very limited extent for pattern making. A piercer hole is made when a conical mandrel cuts the fabric open for a certain penetration depth into the embroidery base fabric and this establishes the diameter of the pierced hole. Embroidering is then carried out around the pierced hole. Decoupling or actuation of each individual piercer independently from another, in the conventional embroidery machines as well as in the embroidery machines already proposed by the applicant, is not intended and it is not possible.

The basic object of the invention is to create an embroidery machine which avoids the disadvantages of surface embroidery machines with single or double heads as well as the disadvantages of known linear embroidery machines, but which, however, combines the advantages of both systems. Hence the object of the present invention is an embroidery machine, especially a surface embroidery machine with universal embroidery heads, by means of which the automatically controlled embroidery stations can be coupled and decoupled individually, in groups, or all together depending on the requirements of the pattern and in which the technological effort for this purpose is intended to be kept relatively low.

A further object of the present invention is to develop universal embroidery heads of this kind in such a manner that they can be supplemented in modular form for further special working processes and in which additional components can be mounted on the given universal embroidery head. This should make it possible for the surface embroidery machine, which has been known for some time and which at present is still a special machine, to be used as an all round machine whose pattern range can be significantly extended also in comparison with that of the linear embroidery machine. It is a further object of the invention to create an embroidery machine, especially a surface embroidery machine, in which the needle piercer drive means are combined so that only one common drive is needed for both features. Moreover, the design will also include an arrangement so that the piercers can be coupled and decoupled individually or in groups in one or several basic guides or at all embroidery stations of the machine in any required manner in order to achieve in this way a wider range of patterns by extending the piercing effects.

SUMMARY OF THE INVENTION

Each embroidery head consists of two independent separate heads, which are arranged on a basic guide together with the embroidery station element so that they can be arranged steplessly and optionally side by side and in a staggered manner relative to each other. The embroidery station elements in the enclosed embroidery station and the separate elements within each embroidery station can be decoupled optionally individually, in groups, and all together as required. At least some of the embroidery station elements are driven mechanically, while in some instances some other embroidery station elements are driven by means of a nonmechanical driving medium (hydraulic, pneumatic, magnetic).

This kind of embroidery head, owing to its universal applicability is designated as a universal embroidery head. Each individual head of such a universal embroidery head consists preferably of a head piece and of a housing, whereby the headpiece can be detached from the housing. The housing can be used as a body for accommodating additional components which are mounted as modular units for extending the embroidery program or for extending the design which can be achieved with the machine according to the invention. An embroidery head of this kind has a width adjustment for the embroidery station elements.

According to a further variant of the invention, the drive of elements in the individual heads which carry out continuous movement, i.e. the embroidery needles, is arranged to carry out nonlinear oscillating movement by mechanical means (e.g. in a conventional manner by means of a rocking drive shaft). The drive of the elements of the individual heads which carry out intermittent movements such as piercers, fabric presser, yarn catchers, yarn cutting arrangement, etc., is arranged to carry out a linear movement by non-mechanical means, the latter being in direct contrast to known proposals, in which also the movement of the latter mentioned embroidery station elements is carried out mechanically. It is especially useful to actuate the drive for the intermittent movement by means of miniature pneumatic cylinders, in which, depending on the selected control method, the intermittent movements for drive can be imparted to all similar embroidery station elements simultaneously or independently of other such components for each individual similar embroidery station element.

Furthermore, according to the present invention the needle bar drive can be independently coupled and decoupled in groups and if necessary independently from the adjacent working heads. The latter is achieved in a special model in such a manner that two mutually independent actuating shafts are provided which can be optionally coupled to each other on the drive side and two certain kinds of preprogrammed control shafts may be provided which act independently of each other on the given actuating shaft, the preprogrammed control shafts control the actuating shafts of the needle bars according to a given program.

Means are provided for extending the range of application of the embroidery machine according to the invention in order to extend steplessly the basic horizontal needle interval. It is useful to carry this out in conjunction with the previously mentioned modular mounted additional elements which can be fitted on the basic body of the given individual head.

The mounting of individual heads of the universal embroidery head according to the invnetion is selected in such a manner that the individual head can be removed in the radial direction from the drive shaft; for example this is carried out by supporting the drive shaft in a semicircular bearing sleeve which is arranged into the individual head housing so that a bearing gap is formed through which the individual head can be removed, the bearing sleeve is clamped down by means of a strap which is in contact with a chordal flat in the sleeve.

Instead of two actuating shafts, for independent operation of both individual heads of a universal embroidery head, only one actuating shaft can be used so that both separate heads can operate independently of each other.

In the universal embroidery head according to the invention the front yard knife is accommodated within the housing of the embroidery head itself and not, as previously, independently outside the embroidery head as a separate machine component, because this is an extraordinarily important feature for the surface embroidery process.

The left hand and right hand individual heads of each universal embroidery head can be formed as units of a basic guide, in which one unit can be moved or adjusted relative to the other unit. This makes it possible to carry out a stepless mutual displacement between the left hand and right hand individual head per basic guide, in which, for example, the group of the right hand individual embroidery heads is fastened on a common rail, which is arranged on the basic guide or which is arranged so that it can move relative to the basic guide.

Also, the drive for the needles and the drive for the piercers can be actuated by a common drive arrangement. This drive arrangement is preferably a toothed, continuous shaft, which is actuated for example, by means of a step motor with a hydraulic system.

With the arrangement according to the invention the piercer is driven purely mechanically simultaneously with the needle drive. When the needle carries out an embroidery process, then the piercer is automatically at rest, and vice versa. This common drive for needle and piercer considerably simplifies the whole design of the embroidery machine head or of the universal embroidery head, the head can be manufactured with smaller dimensions and the drive, as a mechanical drive, is safe and reliable in operation. However, it is necessary in this embodiment according to the invention that, in contrast to the previously used rocking drive with cam discs of 80° to 90°, a greater drive angle be selected; a preferred range is 180° to 200°; this is carried out by using for example a step motor with a hydraulic system.

While in the case of the previously known embroidery machine heads or in the case of the universal embroidery heads previously proposed by the applicant, the piercers all carry out the same working process, it is possible, by means of the invention, to couple or decouple piercers in any required manner, so that the pierced material range can be appreciably extended by this method and the pierced effect can be used for creating patterns. For example, it is now possible to build in a pyramid as a piercing pattern into an embroidery product, while previously the embroidery work (all over) had to be provided with holes. Such a pierced pattern can be undertaken individually and considered as an embroidery station, or, however, in groups, e.g., one or more certain basic guides or all embroidery stations of the machine. The arrangement for coupling and decoupling of the piercer corresponds to the arrangement for coupling and decoupling of the needles with respect to the design features so that a simplified and economical production method for the universal embroidery head is ensured.

Each basic guide of the universal embroidery head is associated with an actuating shaft or with an actuating roll. The basic guide can be coupled or decoupled by means in an enclosed manner; however, individual embroidery stations can be correspondingly programmed on the actuating shaft within the basic guide, so that only individual embroidery heads have a piercer changeover system.

However, in another embodiment of the invention, each actuating shaft or an actuating roll can be associated with a second, third or even further actuating shafts, so that pattern making can be even more widely varied and programmed. This is of importance especially when the piercing pattern is required to be carried out with different diameters. In this manner pierced holes can be formed ranging from a diameter of 0.1 mm up to the buttonhole size without using additional arrangements. This method also simplifies and makes the production of the universal embroidery head cheaper, because a common programming can be used for the needle as well as for the piercer, however, at a different position on the actuating shaft or on the actuating roll.

Programming can be provided axially, radially or by other means, e.g., by means of cams; it can, however, also be carried out electrically or electronically by means of appropriate programming instruments, so that the mechanical system can be supplemented or replaced by an electrical circuit.

Programming can be carried out, e.g., by rotating the actuating shaft or actuating roll, and also additionally by axial displacement over a certain distance whereby further programs can be accommodated on the circumference of the actuating shaft or actuating roll. The needles or piercer units which are temporarily inactivated are fixed into their initial positions by blocking elements which can be brought into the locking position with matching components in the individual heads. These blocking elements can be formed for example as tooth shaped elements, which come into engagement with the corresponding tooth gaps in individual heads and which are mounted in the actuating blocks of the individual heads, so that their height can be adjusted.

BRIEF DESCRIPTION OF THE DRAWINGS

FIG. 31 is a plan view of an embroidery head arrangement according to FIG. 29; and FIG. 32 is a section along the line C-B in the FIG. 31.

Figure 2:
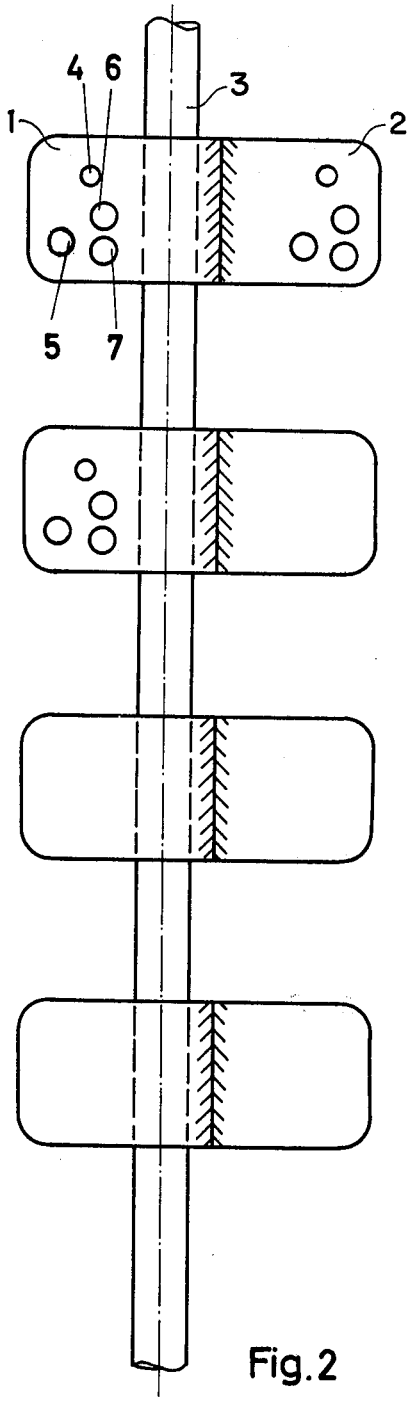
FIG. 2 shows an arrangement of universal embroidery heads according to the invention, in which the needle bars are brought in line.
Figure 1:
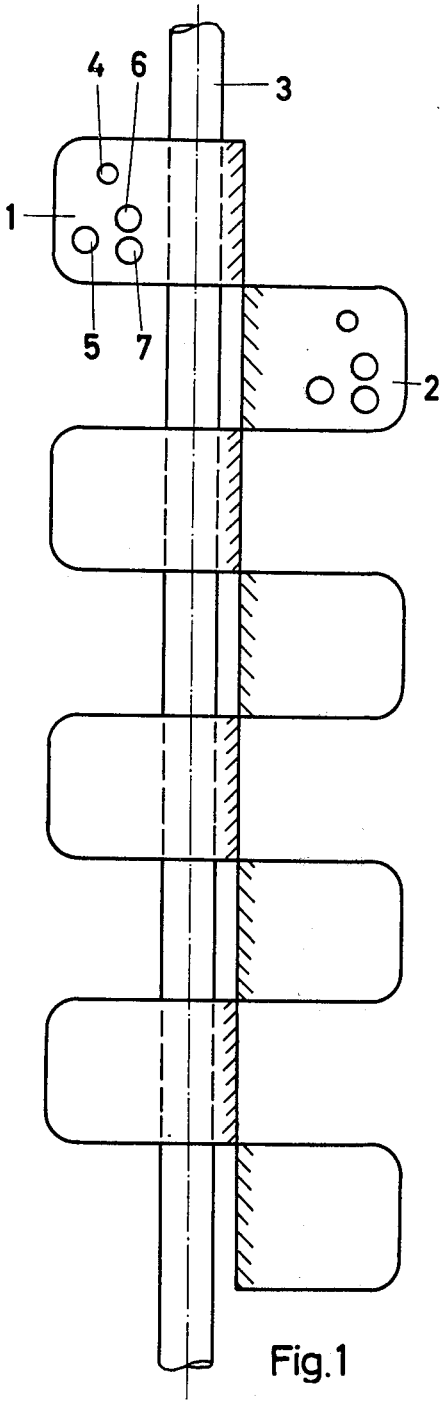
FIG. 1 shows an arrangement of universal embroidery heads according to the invention, in which the needle bars are brought into the gaps.

The universal embroidery head arrangement according to the invention consists of two individual heads, i.e., a left hand and a right hand individual head which are arranged in relation to the basic guides in such a manner that the needle bars of both individual heads are either arranged "on the gap" (FIG. 1) or they are arranged "in line" (FIG. 2). As is usual in conventional arrangements, the horizontal needle interval within a basic arrangement in this case can be 84 mm and the vertical interval can be 96 mm. In the representation in FIG. 1 the individual heads 1 and 2 are placed "on the gap". However, in principle they can also be arranged so that they overlap each other, i.e. they can assume any required intermediate positions in relation to the representations in FIGS. 1 and 2.

The individual head 1 is mounted on the main drive shaft 3 and the individual head 2 is mounted on to adjacent individual heads 1 or on an intermediate component, e.g., on a common rail in such a manner that individual heads 2 can be displaced as a unit relative to the individual heads 1; hence it can be considered that an arrangement can be selected in which the individual heads 2 can vary their distance from each other. Each individual head 1 or 2 has bores for accommodating the needle bar 4 with needle, piercer 5, yarn catcher 6 and the front yarn knife 7. The design of the individual heads 1 and 2, in the case of the representation in FIG. 2 in which the individual heads are arranged "in line", is identical to the case in FIG. 1; both associated individual heads 1 and 2 in this instance are fastened so that their end faces are connected.

Figure 3:
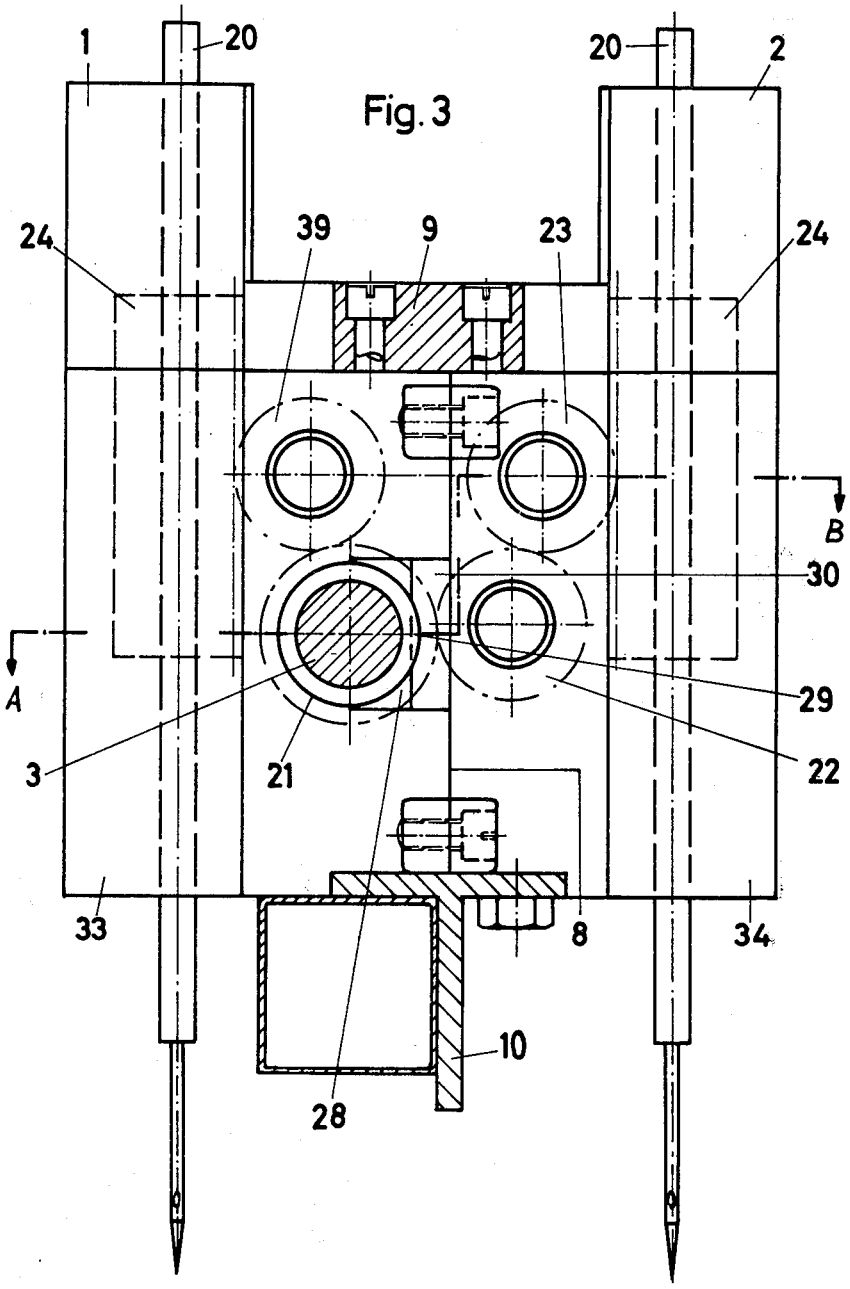
FIG. 3 ahows in side view and in part section a universal embroidery head arrangement according to the invention with two individual heads, which are driven independently from each other.
Figure 7:
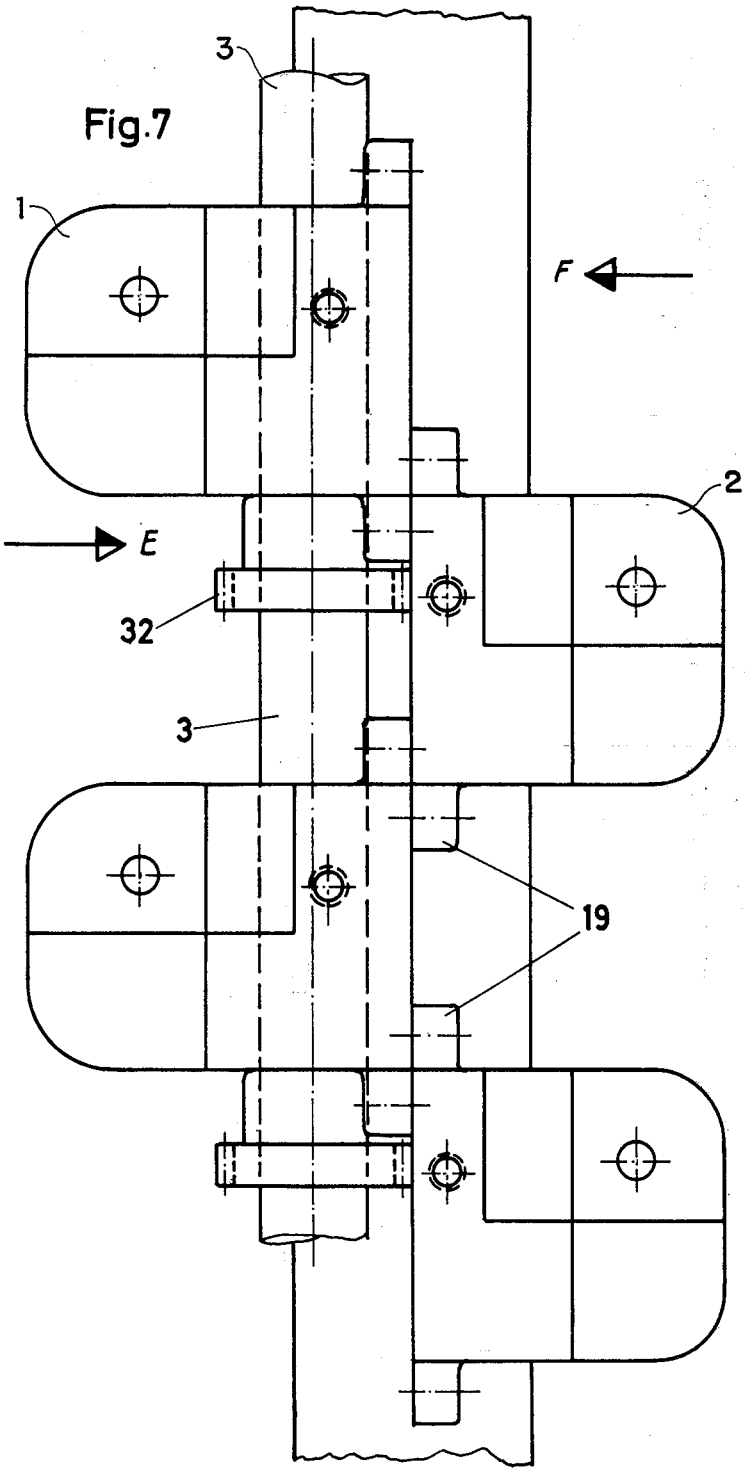
FIG. 7 shows a diagram of the pinion drive for an arrangement of two individual heads "on the gap"
Figure 8:
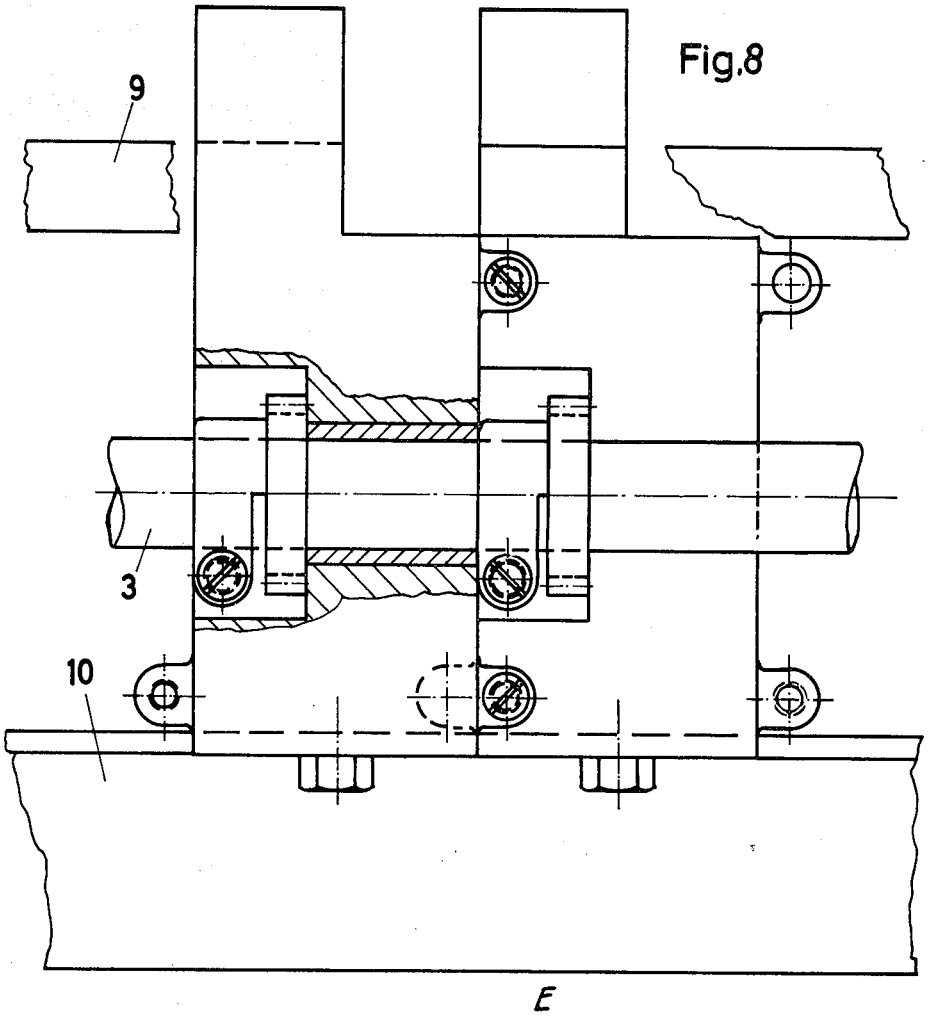
FIG. 8 shows a representation of the arrangement according to FIG. 7 in the direction of the arrow E.
Figure 13:
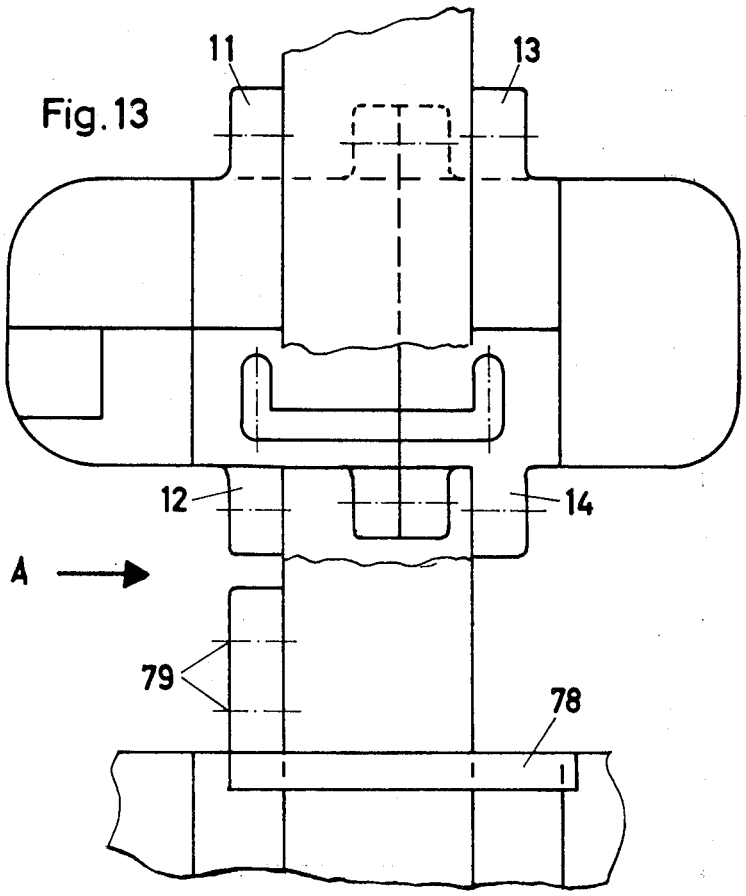
FIG. 13 is a plan view of the representation according to FIG. 11.
Figure 17:
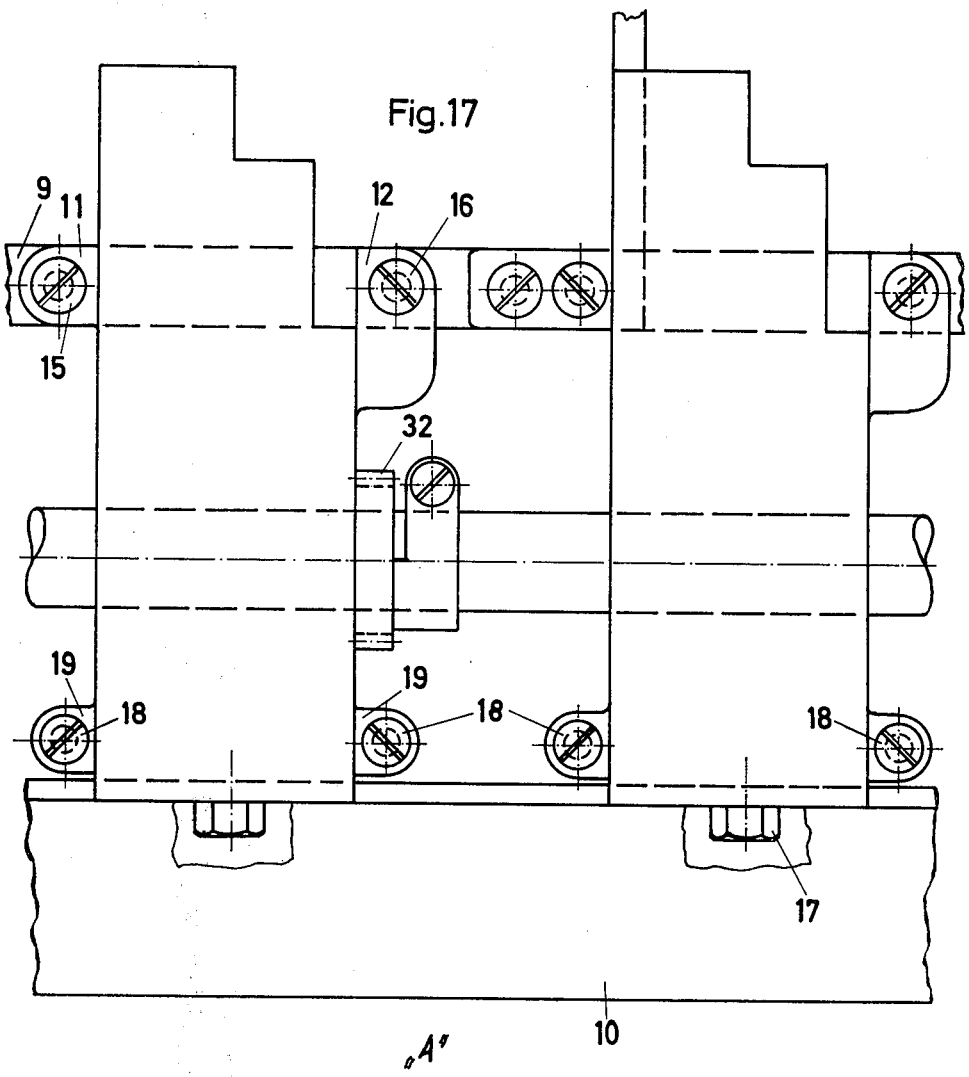
FIG. 17 shows a view of the representation according to FIG. 13 in the direction of the arrow A.

The division of both heads is made along the dividing line 8 (FIG. 3). Both individual heads are clamped between the rear girder 9 and the front girder 10. The individual heads 1 and 2 are fastened on the rear girder 9 by screws 15 and 16 and by means of the lugs 11 and 12 (FIGS. 13, 17) as well as 13 and 14 (FIG. 13). Fastening on the front girder 10 is carried out by means of screws 17 (FIG. 17). The left hand and right hand individual heads are connected with each other by screws 18, which are seated in the lugs 19 (FIG. 17) provided for this purpose. This applies to the neddle bars in the position "in line". When the needle bars are in the position "on the gap", then the mutual bolting of individual heads 1 and 2 can also be carried out by means of lugs 19 (FIG. 7).

Figure 6:
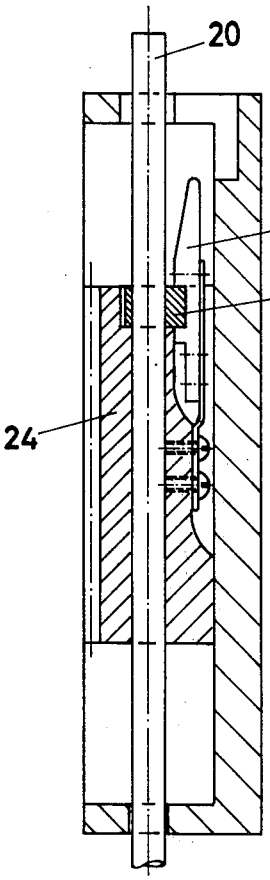
FIG. 6 shows a sectional view along the line C-D in FIG. 4.

Needle bars 20 are driven by the main drive pinion 21 via the intermediate gear wheel 22 and the toothed wheel 23 and by the toothed rack 24 (FIG. 3). The needle bar 20, which can be decoupled, is fitted into this toothed rack 24, the needle bar 20 is connected via the latch 25 and the coupling elements 26 with the toothed rack 24 in a detachable manner (FIG. 6).

Figure 9:
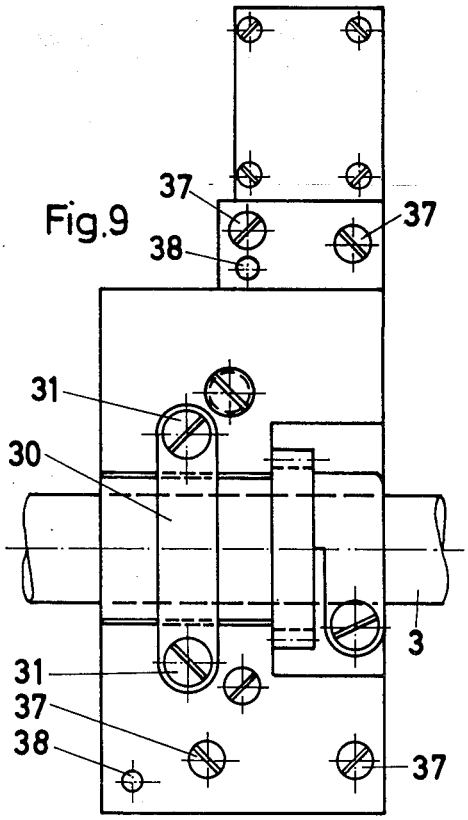
FIG. 9 is a representation of the arrangement according to FIG. 7 in the direction of the arrow F.

The main drive rocking shaft 3 is mounted in a bearing sleeve 27 (FIG. 5) which in turn is mounted into the left hand individual head housing in semicircular form in such a manner that the left hand individual head housing can be removed through the bearing gap 28 (FIG. 3) in a radial direction from the shaft 3. The bearing sleeve 27 has on its outside diameter a chordal flat 29 which engages with a locking element 30 in such a manner that is secures the sleeve 27 against rotation and it holds the sleeve at the same time in the bearing opening of the left hand individual head so that it guarantees a reliable functioning of the shaft 3. The locking element 30 is fastened by screws 31 (FIG. 9). The bearing arrangement of the shaft 3 described here is not necessary for every one of the individual heads which are arranged in a superposed manner into a basic guide and the number of such bearing locations can be significantly lower than the number of the appropriate individual heads.

In this arrangement the driving pinion 21 (FIG. 30) drives both individual heads 1 and 2, when the needle bars are "in line". If the needle bars are adjusted into "on the gap", then for this instance a second pinion 32 (FIG. 7) with the same dimensions is provided which is mounted outside the individual heads on the shaft 3.

Figure 4:
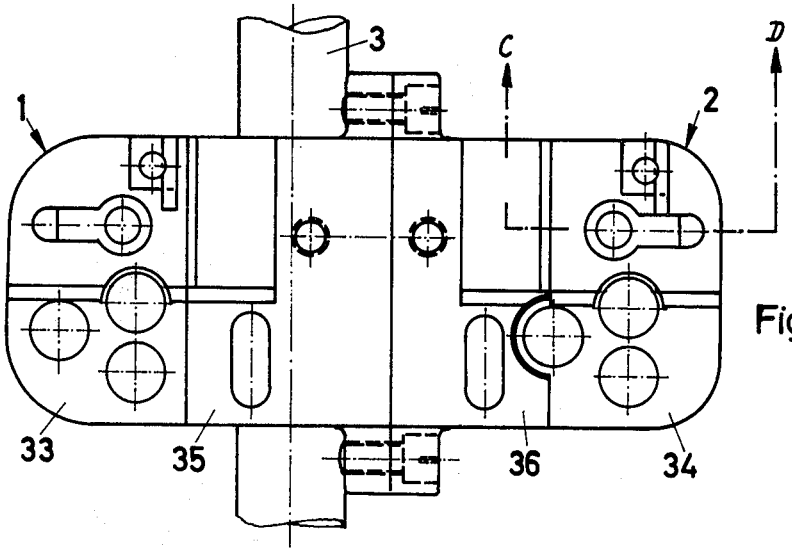
FIG. 4 shows a plan view of the representation according to FIG. 3.

The head pieces 33 and 34 (FIG. 3,4) on individual heads 1 and 2 are connected with the housings 35 and 36 (FIG. 4) of the corresponding individual head, e.g., by means of screws 37 and dowel pins 38 (FIG. 9).

Figure 5:
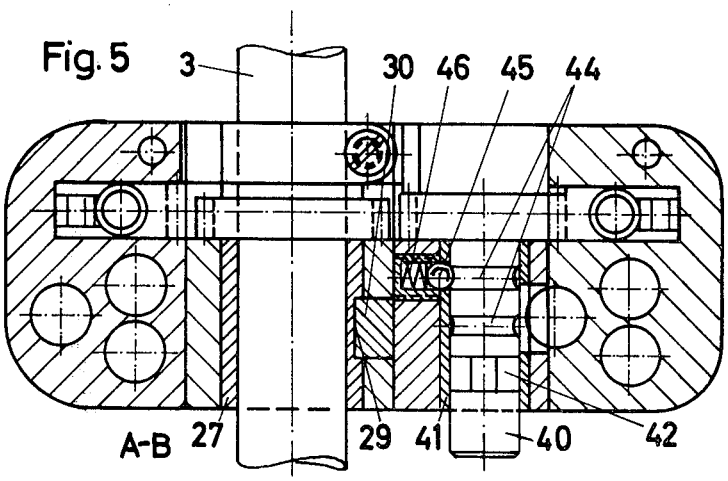
FIG. 5 shows a section view along the line A-B in FIG. 3.
Figure 11:
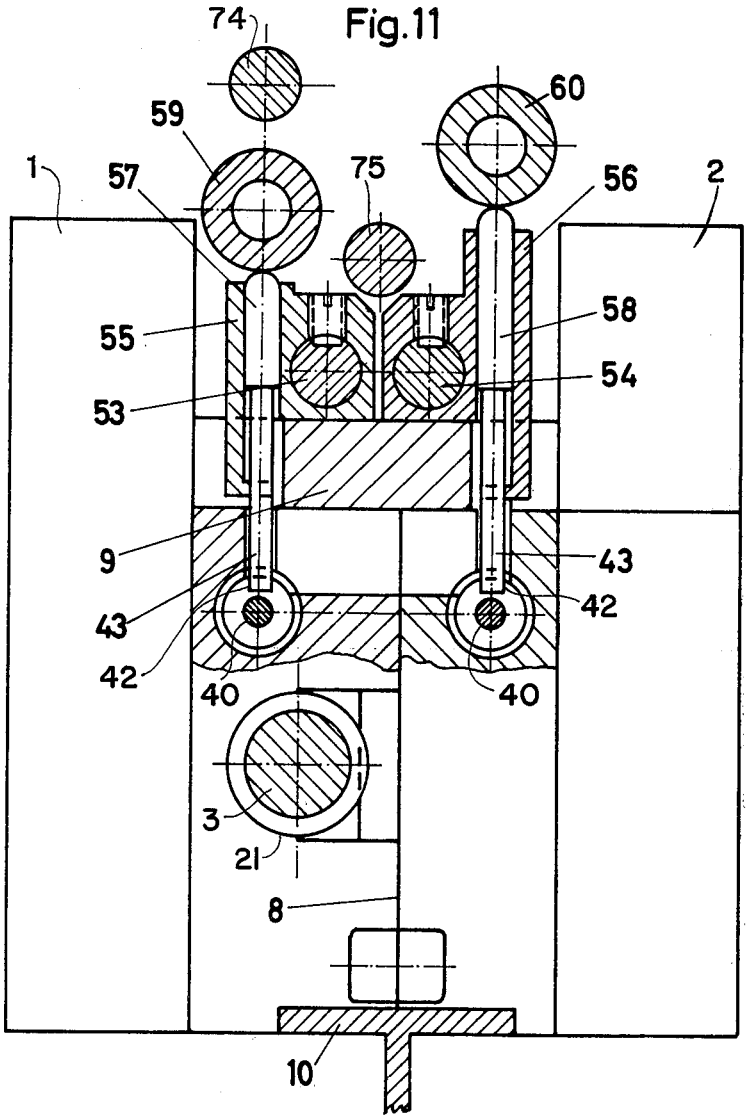
FIG. 11 is a side view and part sectional view of a universal embroidery head arrangement according to the invention with two individual heads which are driven independently of each other.

Toothed wheels 23 and 39 (FIG. 3) together with their shafts 40 are made from a solid in the arrangement according to FIGS., 3, 4, and 5 and they are mounted in the bearing sleeve 41 (FIG. 5) so that they can be displaced axially. Shafts 40 have cutouts 42 which can accommodate pins 43 (FIG. 11). In addition the shafts 40 have spherical seats 44 which engage with balls 45 which are loaded by the springs 46 (FIG. 5).

Figure 18:
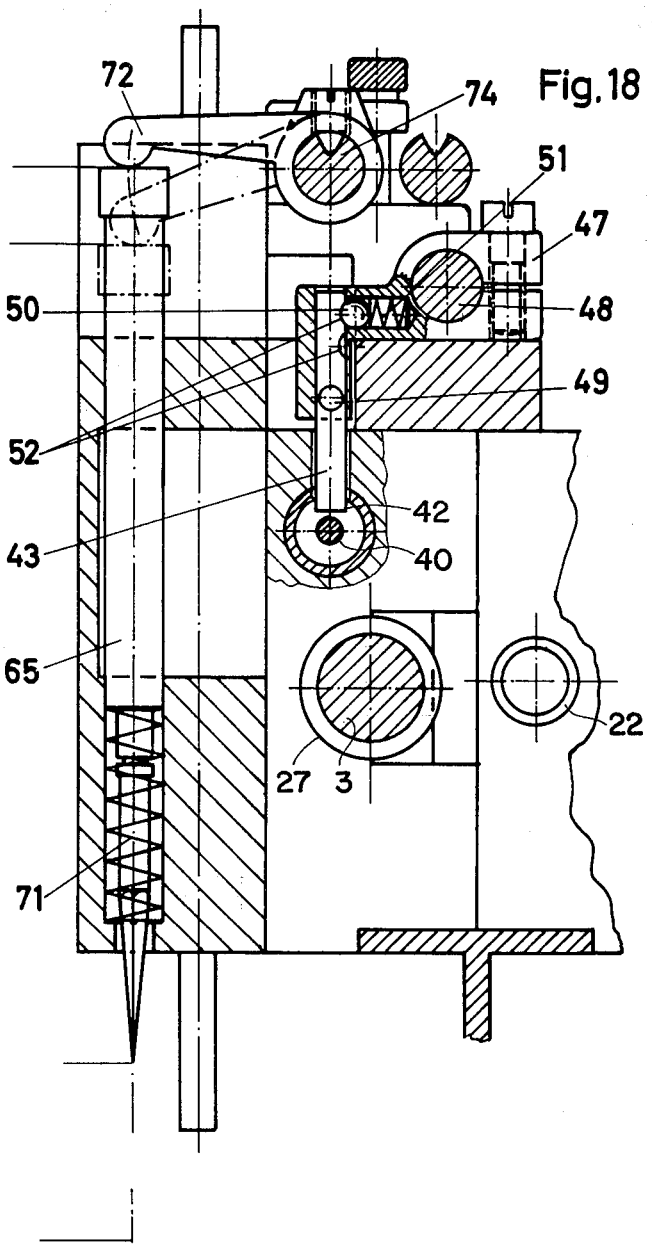
FIG. 18 shows a sectional view of the drive and of the control system for the needle bar for an individual head, in which both individual heads operate independently of each other; an example of the piercer penetration depth control method is also shown.
Figure 19:
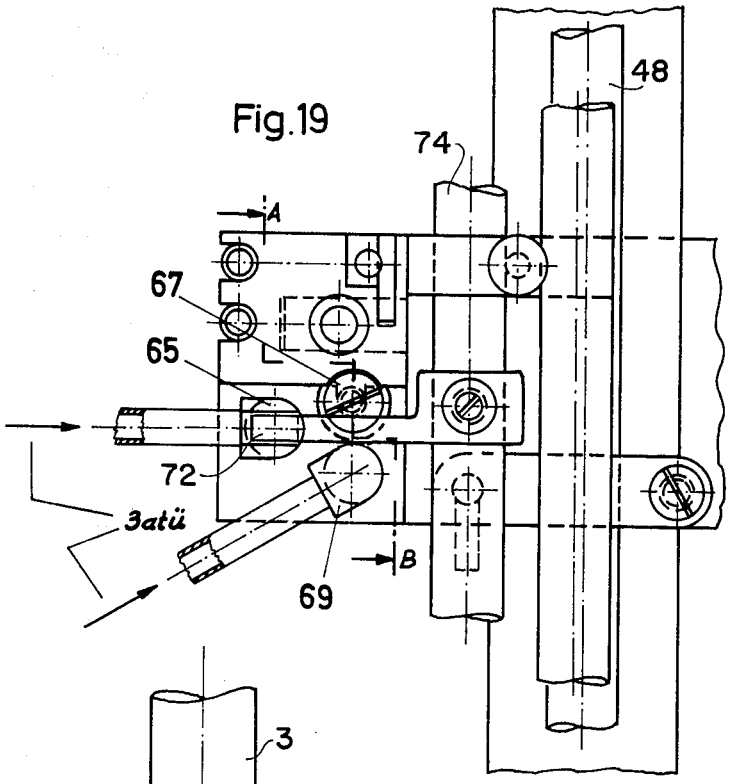
FIG. 19 is a view of the representation according to FIG. 18.

Pin followers 43 (FIG. 11) are mounted in bearing blocks 47 (FIG. 18) which in turn are, e.g., bolted on a common actuating shaft 48 so that they can be adjusted. The pin followers 43 can be displaced in their bearings axially by means of the handle 49 and the ball 50 holds the pin follower 43 in the latching seats 52 in two predetermined positions under the force of the spring 51 (FIG. 18).

Figure 8A:
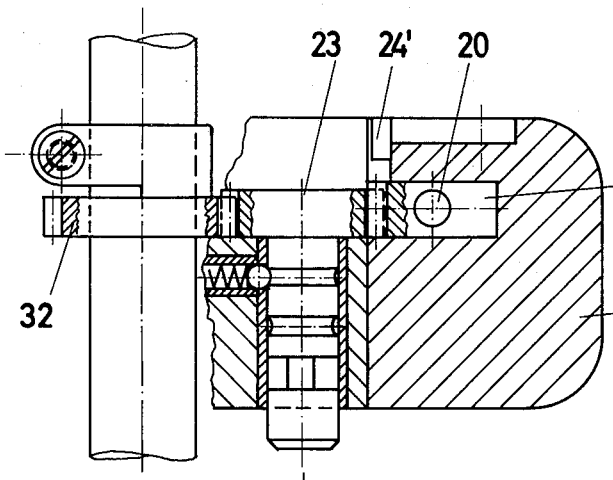
FIG. 8*a* shows a partial view illustrating the working position of needle bars.
Figure 8B:
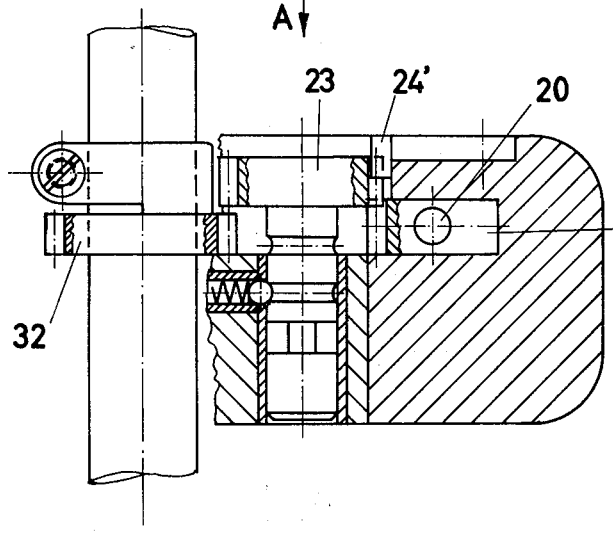
FIG. 8*b* is a view corresponding to FIG. 8*a*, in which the needle bar is decoupled.
Figure 8C:
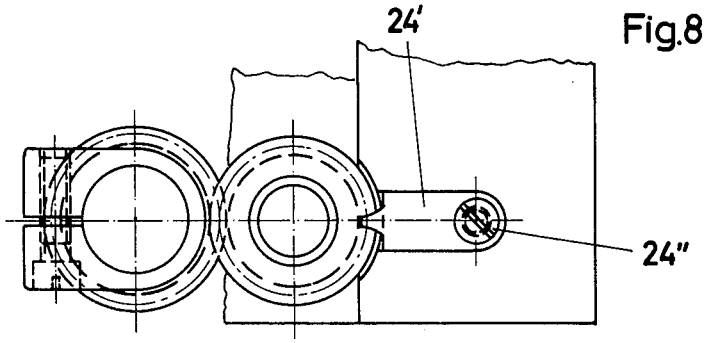
FIG. 8*c* is a plan view of FIG. 8*b;*
Figure 10:
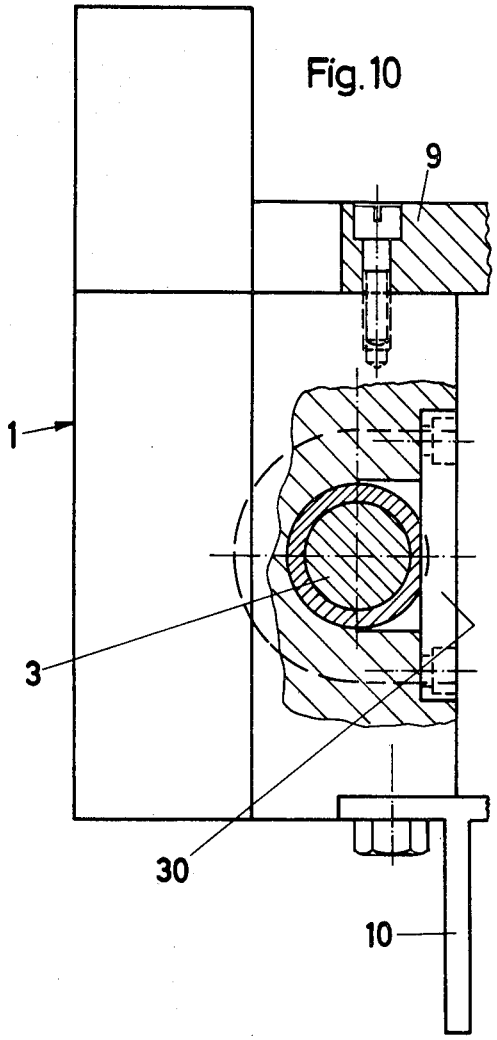
FIG. 10 is a side view of the representation according to FIG. 9.

When an axial movement is imparted to the actuating shaft 48 (FIG. 18) while the pin follower 43 is latched into the lower position, then an axial movement will also be imparted at the same time to the shaft 40 and hence to the gear wheel 23 for the right hand individual head. The length of this axial travel is such that the gear wheel 23 for the right hand individual head 2, and the gear wheel 39 for the left hand individual head are disengaged from their driving gear wheels 22 or 21; however, they still remain in engagement with their needle bar toothed racks 24 (FIG. 3). This method is used to determine which needle bars 20 are to made inactive at a certain point in time. In carrying out the above operations it must also be guaranteed that the needle bar is secured in its decoupled state so that it can reassume its previous position on reengagement. The inactivation of the toothed rack 24, in which the needle bar 20 is fastened so that it can be decoupled, is carried out exactly at the upper dead centre of the movement (FIGS. 8*a*, 8*b* and 8*c*). At this instant the gear wheel 23 is disengaged from the driving pinion 32 by axial displacement while it still remains in engagement with the toothed rack 24. A toothed segment piece 24', which is fastened by the screw 24'', engages with the corresponding available tooth gap of the gear wheel 23 and it holds the toothed rack 24 together with the needle bar as well as with the gear wheel against rotation until the gear wheel 23 is re-engaged, by return displacement, with the driving pinion 32 (FIGS. 8*a*, 8*b*, 8*c*). Since in this case only one actuating shaft 48 (FIG. 18) is provided for both individual heads 1 and 2, both individual heads 1 and 2 are therefore independent of each other.

Figure 12:
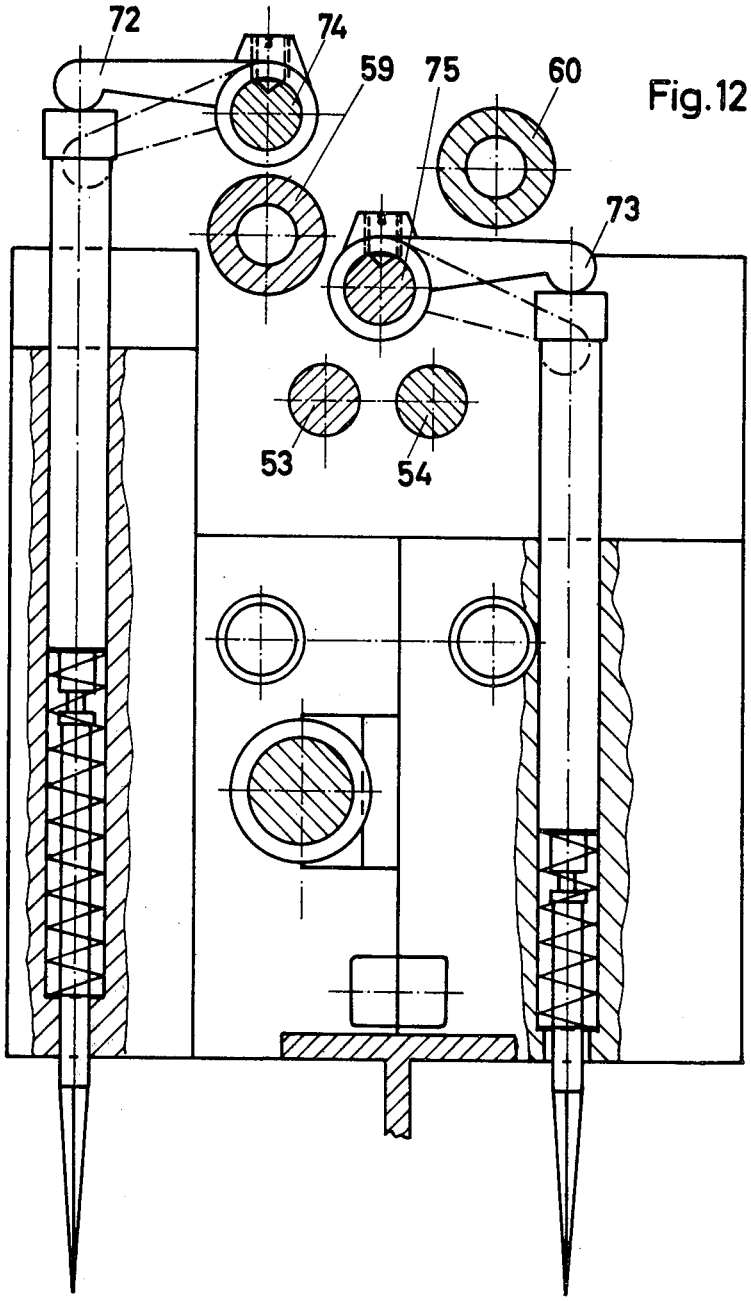
FIG. 12 is a view according to FIG. 11 showing the actuation of the piercer bar system.

In the representation according to FIGS. 11, 12 and 13, an arrangement is shown by means of which both individual heads can operate independently of each other. For this purpose two actuating shafts 53 and 54 are provided, each of which has its own bearing block 55 or 56 respectively, together with the pin followers 57 or 58. In the representation according to FIGS. 11 and 12, in the case of this kind of variant, each actuating shaft 53 or 54 is associated with a control shaft 59 or 60, which accommodates a specified number of working programs which determine the functioning of the actuating shaft.

Figure 14:
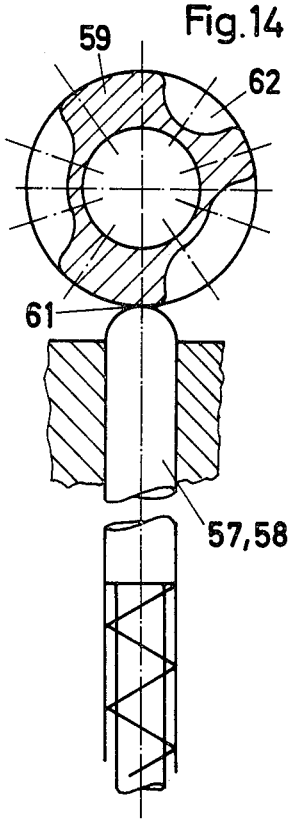
FIG. 14 is a detailed view of a follower pin in conjunction with a control shaft.

The follower pins 57 and 58 are loaded by springs and hence they are in continuous contact with their control shafts 59 and 60. If a follower pin 57 or 58 rests against the circumference 61 of the associated control shafts 59 and 60, then it remains coupled and, when the actuating shaft 53 or 54 is moved, it disengages the corresponding gear wheel and hence it makes the needle bar inactive. If the following pin 57 or 58 drops into an opening 62 (FIG. 14) of the control shaft 59 then, e.g., the gear wheel 23 remains in engagement and the needle bar continues working. The control shafts 59 or 60 can obviously also be designed in such a manner that on the circumference of the shaft, instead of depressions 62, there are projections or actuating lugs. Control shafts 59 or 60 are controlled by commands, which are initiated by punched cards or punched tapes which are used in embroidery technology. Futhermore, each of the control shafts 53, 54 can be controlled by punched cards or similar devices independently of the control shafts 59, 60.

Figure 23:
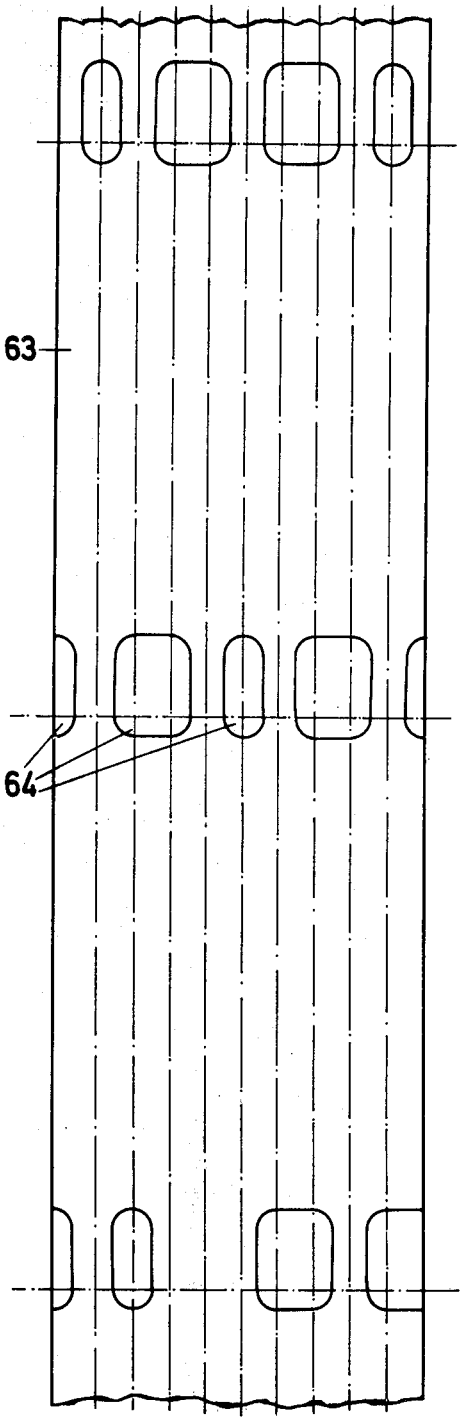
FIG. 23 is a section from the development of a control shaft.
Figure 21:
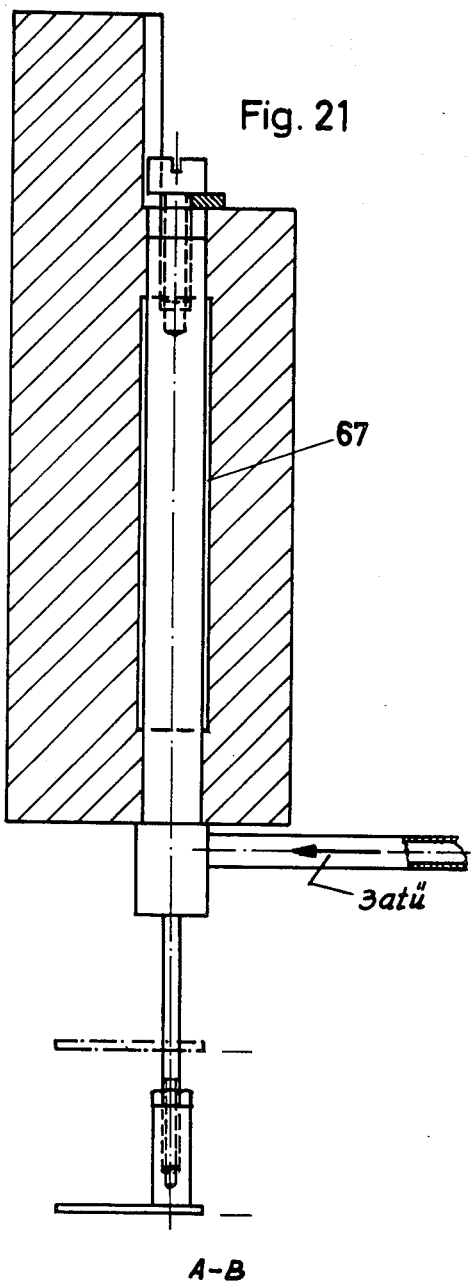
FIG. 21 is a side sectional view of the representation according to FIG. 19.

FIG. 23 designates by the numeral 63 the development of a control shaft which, as an example for a needle height interval of 96 mm, contains preprogrammed depressions 64. Changeover to a different program is carried out by rotating the control shaft which accommodates, at the same spacing, programs of the corresponding number which are displaced on the circumference at equal intervals and which are depressed in the shaft circumference. The control shaft can be stepped by means of a mechanical drive, by means of step switching motors, etc.

While in FIG. 3 the needle bars with needles are mechanically driven by means of the main drive rocking shaft 3, then according to this invention the piercers, yarn catchers and front yarn knives are not driven mechanically and not by a common drive, but each of these elements is provided in a universal embroidery head with its own drive unit, preferably a miniature pneumatic compressed air cylinder. FIGS. 18, 19, 20 and 21 show a corresponding diagram. For the piercers pneumatic cylinders 65 and 66 are provided; for the yarn catchers, pneumatic cylinders 67 or 68, and for the front yarn knives, pneumatic cylinders 69 or 70.

Figure 20A:
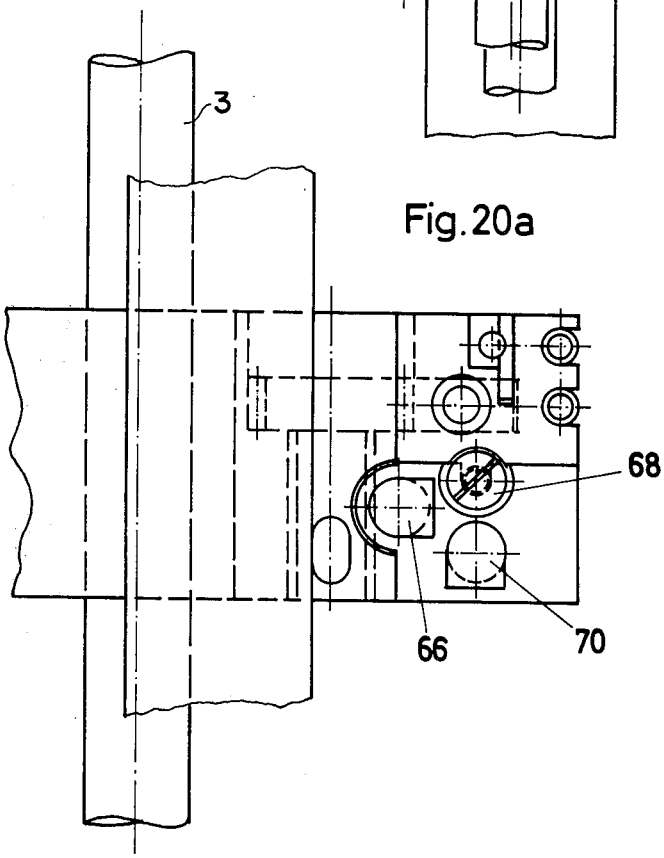
FIG. 20*a* is a view of the representation according to FIG. 20.
Figure 20:
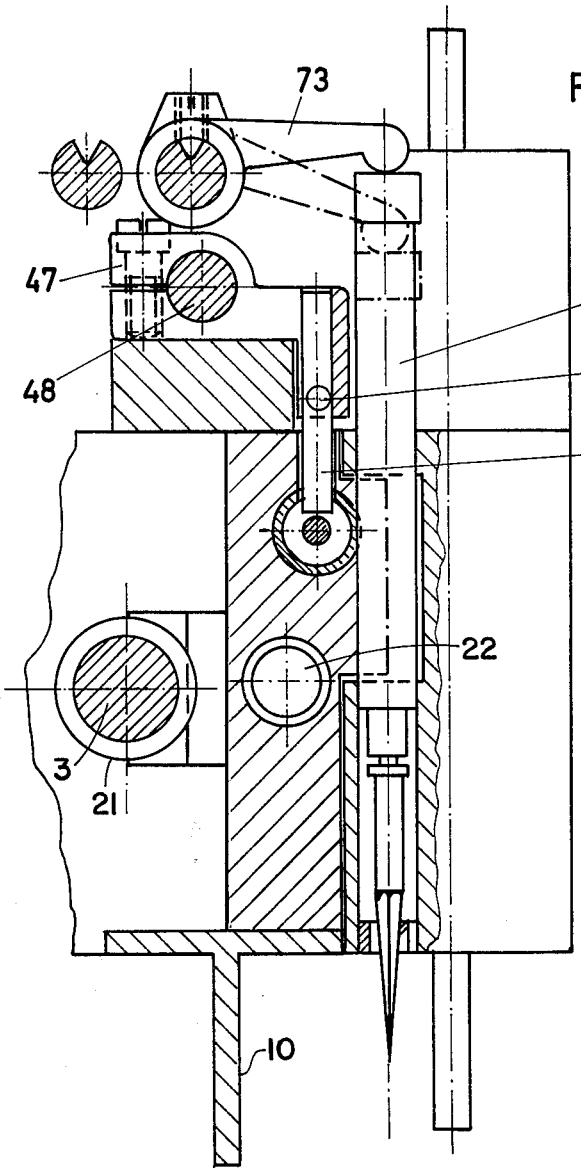
FIG. 20 is a sectional view of the drive and of the control system of the needle bar for the associated individual head, as well as the piercer control system according to FIG. 18.

Pneumatic cylinders always carry out a full working stroke after charging with compressed air. However, the piercers require different penetration depths into the embroidery fabric because the conical shapes of the cutter is used to produce holes of different sizes. This is achieved by the arrangement in which the penumatic cylinders can be axially adjusted and controlled as seen in FIG. 18. The pneumatic cylinder is constantly pushed upwards by the compression spring 71, because it is freely seated in its housing bore. Hence the cylinder and the control levers 72 or 73 form a unit. These levers are mounted on shafts 74, 75 which, when they are rotated by a certain angular displacement, hold the pneumatic cylinders in a corresponding initial position. If now the shaft 74 or 75 is held in different predetermined angular positions, then it is possible to make holes of corresponding size in the embroidery material. Cylinders 67, 68, 69 and 70 (FIGS. 19, 20*a*) are axially fixed, because their strokes determine their working range.

On adjusting the individual heads 1 and 2 "in line" or "on the gap" the driving or control elements 72 or 73 (FIGS. 18, 20) are shifted axially on their shaft in the same manner as the bearing blocks 47 and they are clamped in this new position. All connecting rods of pneumatic cylinders can be secured externally or internally against rotation.

Figure 22:
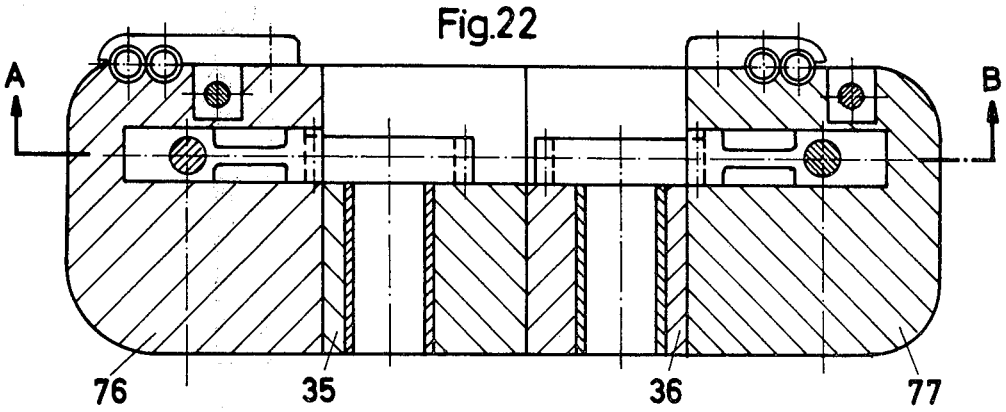
FIG. 22 is a universal embroidery head arrangement according to the invention with increased horizontal needle interval.

According to FIG. 22, there is a possibility of modifying individual heads 1 and 2, with reference to the horizontal needle interval beyond the usual needle interval of 84 mm, by replacing the head pieces 76 or 77, which have a greater interval of the common center line. The housings 35 and 36 remain unchanged in this case.

Figure 15:
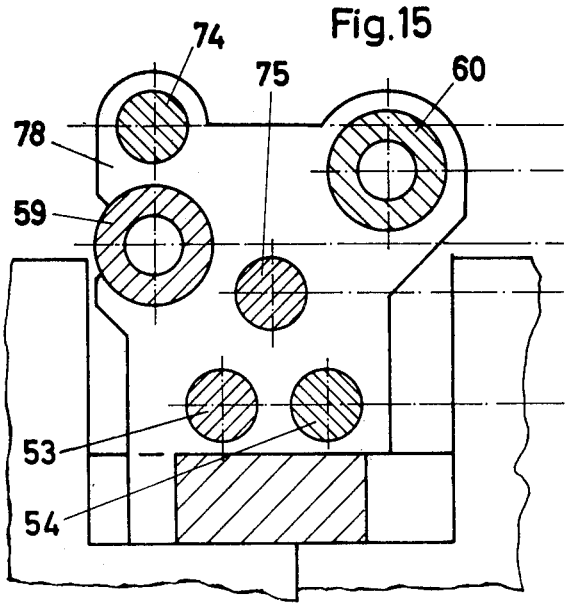
FIG. 15 shows a bearing system of actuating and control shafts which are not shown in FIG. 12 for clarity.
Figure 16:
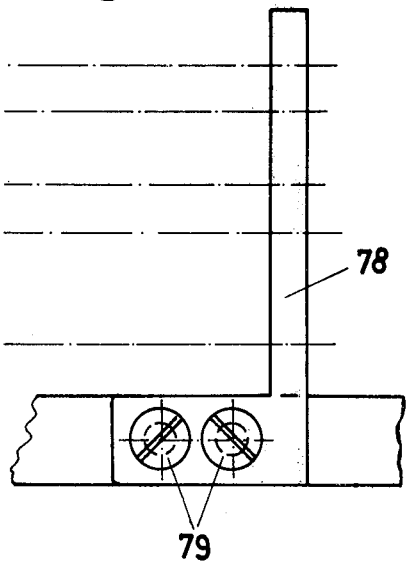
FIG. 16 shows a side view of the representation according to FIG. 15.

Mounting of all the switching and control shafts is shown in FIGS. 15 and 16. These shafts are mounted in bearing blocks 78, of which only a smaller number are provided over the whole length of a basic guide. Each bearing block 78 is fastened by screws 79 on the rear belt 9.

Figures 24, 25, 26:
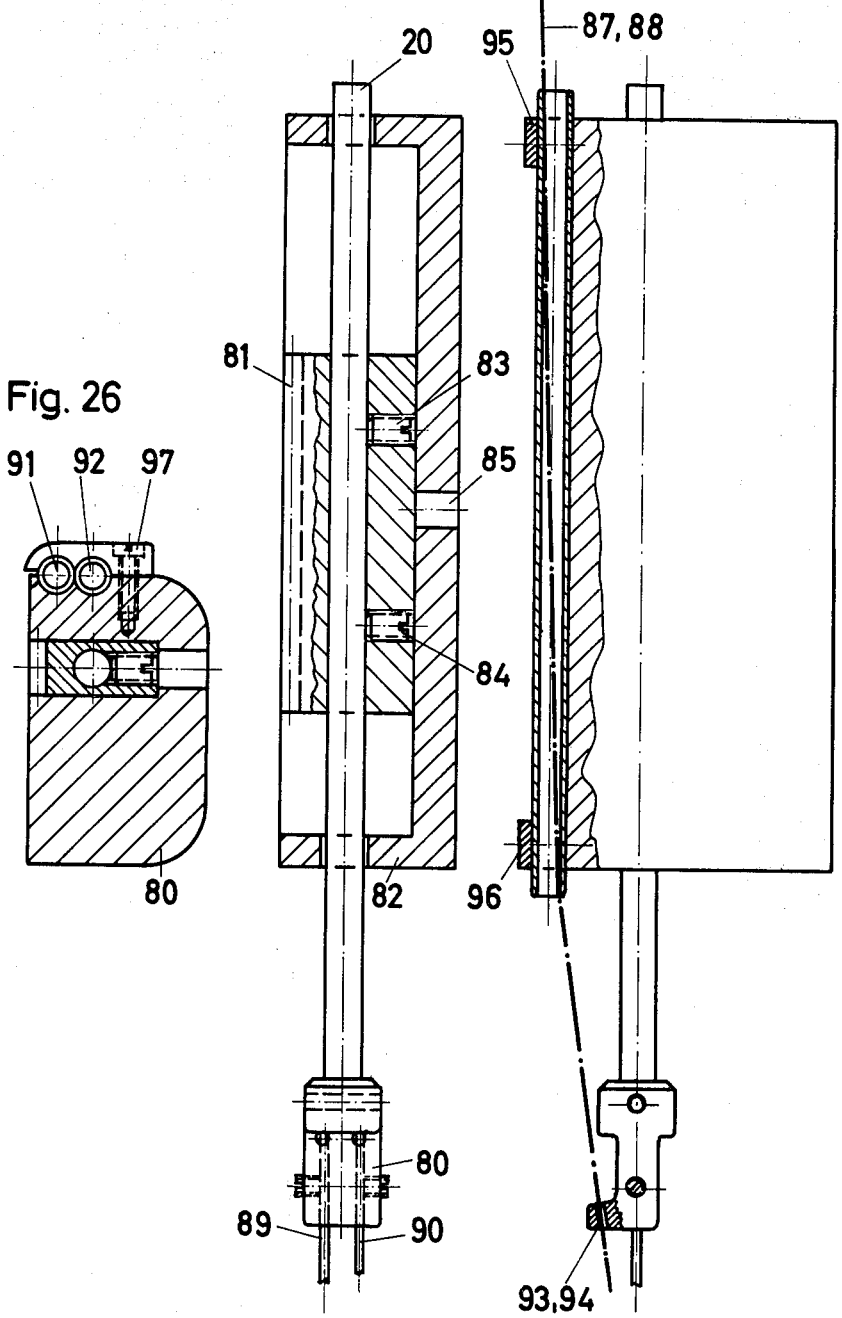
FIg. 24 is a sectional view through a universal embroidery head with twin needle bar.
FIG. 25 is a view of the arrangement in FIG. 24 from the side and partial section view.
FIG. 26 is a cross sectional view through the representation according to FIG. 24.

FIGS. 24, 25, and 26 show an individual head of the universal embroidery head according to the invention with a twin needle bar. The twin needle head 80 is fastened on the needle bar 20. The needle bar 20 is moved axially by the toothed rack 81, which is enclosed at all sides in the head 82 but it can slide. The needle bar 20 is held by screws 83 and 84, which are accessible from outside through holes 85, so that it can slide axially and it can rotate. The oscillating drive of the toothed rack 81 is provided in the usual manner by toothed gear wheels; however, in order to preserve clarity it is not shown. The needle yarns 87 or 88 for needles 89 and 90 are fed through the yarn tubes 91 and 92 and through the yarn guide holes 93 and 94 on the needle head, from whence they are guided further into the eye of the needle (not shown). Yarn tubes 91 and 92 are clamped by straps 95 and 96 and by screws 97 on the head 82.

Figure 27:
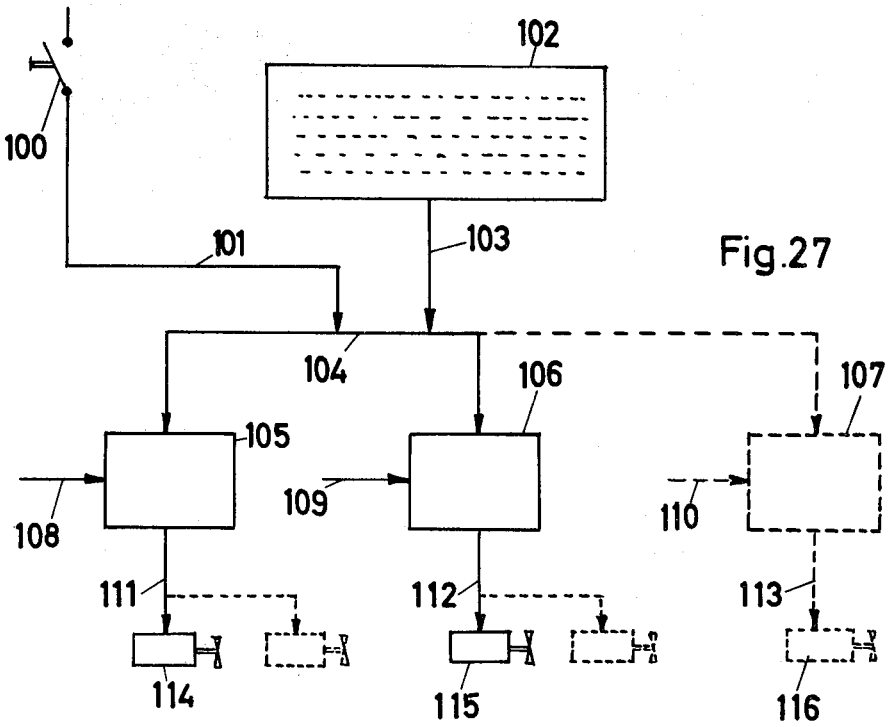
FIG. 27 is a circuit diagram for an embroidery field racking.

FIG. 27 shows a circuit diagram for the control of embroidery field racking. This circuit diagram shows one of the possibilities for such a control arrangement. The starting command for the embroidery field racking comes from a manually actuated switch 100 via the conductor 101 in the case of manual operation or from a pattern punched card 102 via the conductor 103 in the case of automatic control. Conversion of this command into an electrical pulse is carried out in a conventional manner and the starting pulse is supplied via a conductor 104 into an arrangement 105 or 106 or 107 (for yarn catcher, for front yarn knife, etc.) which has a signal store and a signal connection. These arrangements 105, 106, 107 are provided with triggering signals 108, 109 and 110 whcih are derived, for example, from other machine movements or which are obtained via time or sequence control stages (not shown). This fixes the point of time and duration of the energizing of individual solenoid valves 114, 115, or 116, which are connected via lines 111 or 112 or 113 with arrangements 105 or 106 or 107. The solenoid valves shown by broken lines in FIG. 27 can be connected in parallel with the solenoid valves 114.

Figure 28:
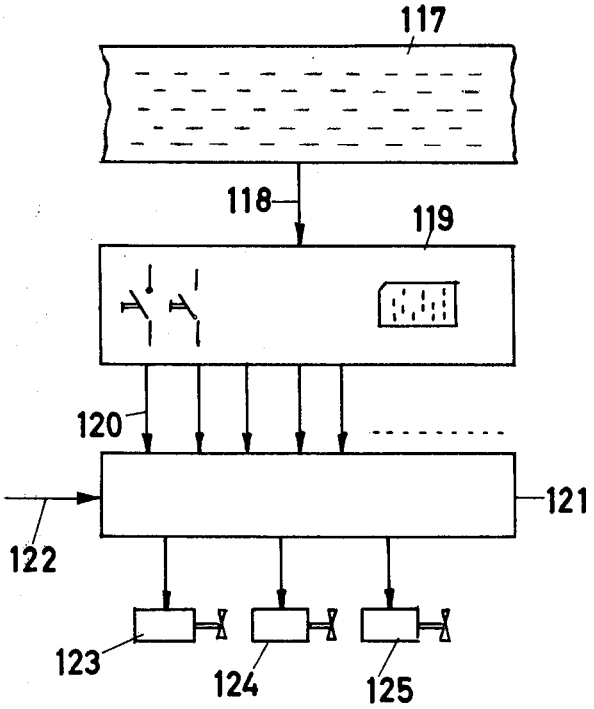
FIG. 28 is a circuit diagram for an embroidery station for producing patterns.

On selecting embroidery stations according to FIG. 28 for making patterns the command for actuation of a piercer is given by a pattern punched card 117, or by a corresponding data carrier, via the conductor 118 to an arrangement 119 in which the selection of embroidery stations is carried out via a manual switch or by similar means. Corresponding starting pulses are fed by the arrangement 119 to the signal store and to the signal connection 121, from which the point of time and duration of the energizing of the corresponding solenoid valves 123, 124, 125 for the piercers are fixed via a triggering signal 122 in the same manner as described in FIG. 27.

Figure 30:
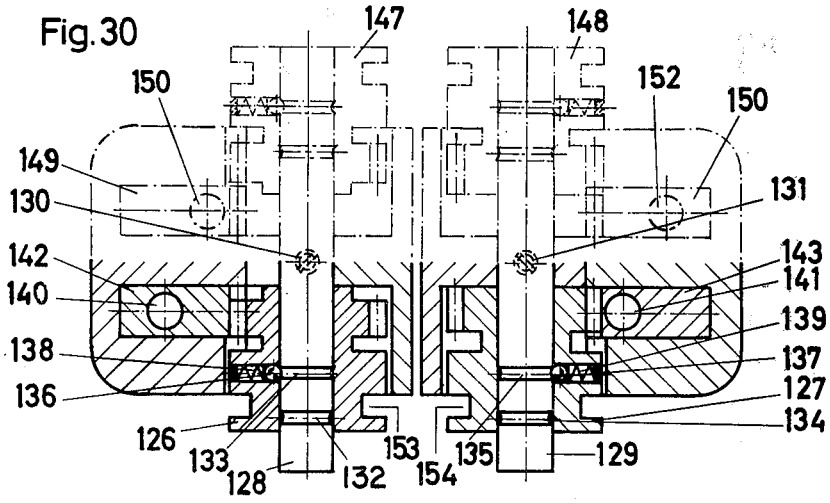
FIG. 30 is a section along line A-B in FIG. 29.

The part of the section A-B shown with broken lines according to FIG. 30, which represents the needle repeat change for both heads of the universal head, corresponds to FIG. 5. The sliding gear wheel 126 for driving the piercer of the left hand head and the sliding gear wheel 127 for driving the piercer of the right head are in the same plane. All sliding gear wheels, and also those for driving needles, rest on fixed shafts 128 and 129, which are held in the left hand head by a screw 130 and in the right hand head by a screw 131. Shafts 128 and 129 have semicircular grooves 132 and 133 or 134 and 135 respectively, which are used for latching of the sliding gear wheels 126 or 127 by means of latching balls 136 or 137 and springs 138 or 139, when they are pushed axially along the shaft. Piercer bars 140, 141 are fastened into toothed segments 142 and 143 of the left hand and right hand head; they are moved upwards or downwards by means of the sliding gear wheels 126 or 127 which are in engagement with them.

The sliding wheel 27 is driven by the intermediate gear wheel 144, which in turn is in engagement with the driving rocking shaft 145, while the sliding wheel 126 is directly engaged with the driving shaft 145, which is toothed axially over its whole length, so that it represents an infinitely wide gear wheel.

Figure 29:
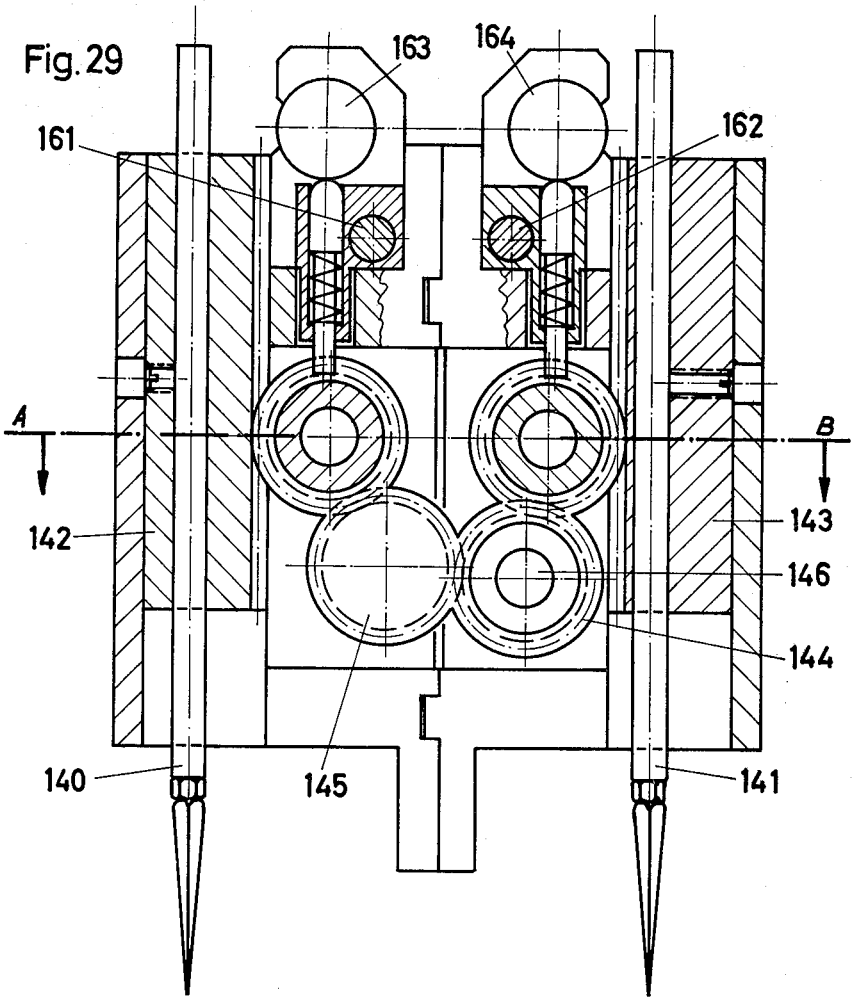
FIG. 29 is a detail view of an embroidery head arrangement with two adjacent embroidery heads in section through the piercer drive according to a further variant of the invention.

In further variant of the invention, the driving rocking shaft 145 (FIG. 29) can be formed also as a multispline shaft on which are pushed a number of gear wheel units which are arranged in series axially and which are provided with axial splines to match the multiple spline shaft.

The intermediate gear wheel 144 is free to rotate, but it is fixed axially on the fixed shaft 146 (FIG. 29) on whose other end (not shown) is fitted a second intermediate gear wheel which is used to drive the right hand needle bar.

Since the needle and the piercer operate alternately, i.e., never at the same point of time, it is possible to drive both only by a single driving rocking shaft 145 in an ideal manner.

The strokes of a different nature which the needles or piercers may need, and for which correspondingly different rocking angles are necessary, are controlled by the driving arrangement of the rocking shaft, which can be, for example, a step motor, which works preferably by hydraulics.

In FIG. 30 the sliding gear wheels 126 and 127 are in engagement with the toothed segments 142 and 143 and this is their working position. At the same time the sliding gear wheels 147 or 148 which are drawn with broken lines disengage from their toothed segments 149 or 150 (needle drive). In this case the needle bars are designated 151 and 152. The sliding gear wheels 126 or 127 have at their outward facing ends cutouts 153 and 154 in the same manner as in the sliding wheels 147 or 148.

Since the axial distances of the sliding gear wheels 126 and 147 or of 127 and 148 are constant and, hence, also their cutouts are always constant, the coupling bearing block 155 or 156 can accommodate both follower pins 157 and 158 for the left hand, or 159 and 160 for the right hand head.

The coupling process by means of the actuating bars 161 or 162 and the control process by means of the control shaft 163 or 164 (FIGS. 29, 31), by means of which the follower pins 157 and 158 or 159 and 160 are located in the cutouts 153 or 154 or which are moved out of them, are carried out in principle in the manner specified above; however, in the case of the present invention they are also simultaneously used for the piercer repeat change.

The programming is carried out not only by rotating the control shafts 163 or 164 (FIGS. 29, 31), but additionally by axial displacement over a certain distance, by which it is possible to accommodate further programs on the circumference of the control shafts within the intervals from 157 to 158 or from 159 to 160 (FIG. 31).

The needle piercer units which are made inactive from time to time must be held in their initial position in such a manner that the sliding gear wheels can be reengaged accurately. For this purpose blocking pieces 165, 166 or 167, 168 (FIG. 31) are provided, whose one end face is formed into a single gear tooth 169 (FIG. 32) which can engage with a tooth gap of the particular toothed segment 142, 143, 149, or 150 which may face it. Blocking pieces which can be shifted vertically in the coupling bearing blocks 155 or 156 are arranged so that the tooth block 169 can enter correctly into the facing tooth gap and they are locked by screws 170, 171, 172 or 173 (FIG. 31) after adjustment.

The actuating shafts 163 or 164 are connected in a further variant of the invention to a second, third or even further actuating shafts.

ADVANTAGES OF THE INVENTION

According to the invention the following advantages are achieved among other aspects:

1. In contrast to the mono or duo embroidery head it is now possible to achieve a simultaneous arrangement of embroidery heads on a common basic guide in a staggered and linear manner. This results in a saving of about 50% of basic guides.

2. The technological total outlay for components can be appreciably reduced (about 4000–6000 separate components fewer per machine), referred to a machine with known mono and duo head, without having to consider any possible disadvantages.

3.The compact design of the universal embroidery head ensures an unobstructed view and an unimpeded access to the embroidery basic fabric.

4. The universal embroidery head solves the problem of individual, group or total coupling and decoupling of automatically controlled embroidery stations depending on the pattern requirements. For example, it is not possible to make burnt-out lace with previously known surface embroidery machines with mono or duo embroidery heads because for this kind of embroidery a basic fabric must be etched out after the embroidery process. For this etching processing it is necessary that in the first instance a basic guide stiches a suspension hem, in which case no other basic guide must produce embroidery; only after this hem for facilitating aftertreatment has been stitched, must all the embroidery stations of the machine embroider the pattern over the whole surface area. This method can be carried out on standard linear embroidery machines without any effort, because embroidering is carried out here line by line. However, this is not possible on previously known surface embroidery machines.

5. Furthermore, it is possible to couple and decouple embroidery heads as required which is especially necessary for color embroidery, so that the application range of a surface embroidery machine is appreciably extended by means of the embroidery head according to the invention.

6. The embroidery head according to the invention can be supplemented by further additional accessory components for a large variety of patterns. For example, an additional drive can push a simple lever to an adjustable amount sideways. In this case the lever grips at a suitable moment the needle yarn (at the uppermost position of the stroke of the needle) and pulls it sideways; after this the needle again penetrates the fabric. A loop is formed when the lever returns into its initial position. In this manner a pile loop or a velvet pile is formed. If the loop is not cut, the embroidery product produced in this manner is a carpet embroidery, tufting or a terry towelling; if the pile is cut then plush or velvet is obtained. Hence, it is possible with the embroidery head according to the invention to mount additional components directly on the basic design in order to obtain new embroidery pattern products.

7. Furthermore, the universal embroidery head can also couple and decouple the piercer in any required manner as in the case of the needle, which was previously not possible with the linear embroidery machine. The range of patterns which could be produced previously with the linear embroidery machine can be appreciably extended with the embroidery machine according to the invention with the universal head, and completely new patterns can be embroidered.

8. The needle and piercer drive are combined into a common drive, whereby the overall design of the embroidery head is considerably simplified.

9. The width adjustment of the embroidery station elements within an individual embroidery head makes it possible to reduce considerably the number of required basic guides and to create additional pattern possibilities, which could not be achieved with previous means.

In principle, according to the invention the movement arrangement selected is such that the needle is operated continuously and the yarn catcher, piercer, front yarn knife, etc., are arranged to operate intermittently or their movements are interrupted; this is in contrast to the mono or duo embroidery head arrangement in which the stitching functions were carried out exclusively purely mechanically by means of linkages and lever systems, adjusting levers, etc. While the needle must work continuously in continuous operation, the yarn catchers, front yard knife, etc., become active only if an embroidery field racking occurs (approximately every 6 to 10 minutes) and then only for one to two strokes in which every time a straight line movement is carried out. The piercer is also moved in a straight line; however, the stroke frequency is higher, about ¼ of the full pattern stitch number, i.e., about every 6 to 10 minutes one quarter of the strokes are piercer strokes. While the continuous actuation of the needle is carried out purely mechanically as previously, the intermittent actuation of the yarn catchers, front yarn knives, piercers, etc., is carried out according to the invention by means of a different operating medium which carries out the movement immediately and directly. This operating medium can be the force of a magnet or a hydraulic force; however, a miniature pneumatic system is used as the preferred arrangement in which the working medium is air.

A further significant advantage of the universal head according to the invention is that a widening is possible. As is well known, the needle lateral standard interval is fixed at 84 mm. This dimension results from 4/4–12/4 repeat (84 mm) which is the most widely used in embroidery work; alternatively, it is also due to space requirements. For certain articles, e.g., in the domestic textile sector, especially in irregular patterns, a larger, i.e., wider needle lateral interval is required in the embroidery work. Previously it was necessary not only to move the basic guides apart — embroidery heads have only one fixed, given dimension — but it was also necessary to dismantle one part of the embroidery head of the basic guide. This causes loss of time and money which is avoided in the case of this invention by arranging the head piece in the universal embroidery head of each mounted embroidery head so that it can be dismantled and replaced by a different head piece, in which the needle interval is increased by means of spacer pieces beyond the 84 mm dimensions. The housing of the particular individual head remains unchanged in this case.

It is proposed in a further variant of the invention to arrange a certain twin needle head on the needle bar. In this manner it is possible to extend appreciably the range of patterns which can be achieved with the machine according to the invention, especially with respect to color embroidery, because each needle yarn in the twin needle head can be of different color or they can be of different structure. In this case, in a useful variant yarn, guiding tubes for both needle yarns are clamped on the needle head, for example, by straps.

On using a driving medium which differs from mechanical systems, e.g., compressed air, for driving of the embroidery tools, with the exception of the stitching needle, a specially useful and space saving arrangement with respect to the design is obtained for the machine according to the invention because the driving medium involved is supplied to the universal embroidery head itself in all instances. As already described above, this working medium, which replaces mechanical systems can also be a pressurized liquid or magnetic force instead of compressed air or compressed gas; the application of a pneumatic system in association with miniature pneumatic cylinders, however, has been found to be especially useful and effective.

The control of individual drive elements is carried out either by hand or by means of a pattern punched card. When a full field has been removed and if this full field is replaced by a new one, then an embroidery field racking must be carried out for each kind of embroidery. The movements of the yarn catcher, front yarn knife, etc., which are required for such embroidery field racking are carried out preferably by electropneumatic methods. In this case a number of embroidery stations, e.g., a complete basic guide can be connected by air lines and they can be operated by a common solenoid valve. This always involves all embroidery stations. The starting command for the embroidery field racking comes from the pattern punched card or from another corresponding data carrier and it is converted into an electric pulse. This process can also be initiated by means of a manual switch. The starting pulse is fed into appropriate pulse stores and connecting circuits. The point of time and duration of energizing of individual solenoid valves and hence that of the corresponding embroidery tool is established in conjunction with the triggering signals which are derived from other machine movements or which are obtained by time and sequence control stages.

On selecting an embroidery station for creating a pattern, the necessary movements of the piercers are carried out especially by the electro-pneumatic method. A grouped connection and control is possible by means of a common solenoid valve only for embroidery stations which always work together. Depending on the development stage, a corresponding number of groups are available and in extreme case each embroidery station is provided with its own solenoid valve.

The command for actuating the piercer arrives once again from the pattern punched card or from an appropriate data carrier. Commands are further processed as described above, in conjunction with the embroidery field racking, and they trigger the given working process by energizing the solenoid valve. Selection of the embroidery stations which participate in making the pattern can also be contained in the abovementioned data carrier. However, it is also possible to carry out this selection by means of a separate punched card or an appropriate means. Similarly, it is possible to select individual embroidery stations or groups by means of a manual switch.

For example, in practice a machine in the basic form has no selection scope, i.e., the command "piercing" influences only one single solenoid valve from which all piercers are actuated together. For later re-equipping of a basic form machine a selector arrangement must hence be provided; moreover, a special solenoid valve with corresponding signal storage and with corresponding connecting circuits must then be provided for each group to be formed.

Owing to the wide variety of switching possibilities within the above described control systems in which one enclosed basic guide with two embroidery stations and/or with only one embroidery station of a basic guide and/or certain embroidery stations can be switched within the individual basic guide, there results an extremely wide range of patterns in which it is also possible to carry out clearings during a pattern embroidery process.

It is also possible to control, i.e., to couple and decouple, every universal embroidery head according to the invention individually. This controlling method can be achieved if the operating medium, for example air, is supplied instead of or in addition to the central supply per embroidery station and if this special supply is controlled, when compressed air is used, e.g., by means of multiway valves from the main supply. In the mechanical section, the follower pin is not then controlled by means of the actuating shaft, but e.g. by solenoid valves etc. For this purpose, however, electronic switching elements can also be used and hence every individual embroidery station can be controlled electronically.

On considering the application of such special models of the embroidery machine according to the invention, application possibilities are found, for example, where the form part concerned, e.g., a Japanese kimono, requires a large area in the overall embroidery field, so that for this embroidery purpose there remains sufficient room for the components which demand a great deal of space, such as hoses. For products of this kind, naturally the number of embroidery stations is small. By means of the above described techniques, it is now possible for example, to produce directly by machine genuine Japanese kimonos, which are at present made as handicrafts, with similar colored pictures, so that no difference can be detected in the quality of embroidery.

Other advantages and modifications will readily become apparent to those skilled in the art, and all such modifications are desired to be covered by the claims attached hereto.

What is claimed is:

1. An embroidery machine including at least one embroidery station, each such station having at least one universal embroidery head, each universal head accommodates on the needle side thereof a plurality of embroidery station elements including needles, piercers, fabric pressures, yarn catchers and front yarn knives;

means coupled to said elements for adjusting said elements vertically and horizontally over an embroidery field;

a basic guide;

each universal head comprises two individual heads (1,2) associated with said elements;

means for selectively arranging said individual heads, together with their corresponding elements, on said guide side by side, staggered, or steplessly relative to each other, whereby said elements are adapted to become selectively coupled and decoupled individually, in groups, or all together; and driving means including mechanical means for driving at least some of said elements in said embroidery station.

2. The embroidery machine according to claim 1 and non-mechanical driving means for driving at least some other of said elements.

3. The machine of claim 2 wherein said non-mechanical drive means (65–70) drive those of said elements including the piercers, yarn catchers and front yarn knives that carry out an intermittent movement in a straight line.

4. The machine according to claim 3 wherein the drive for the intermittent movements is a miniature pneumatic cylinder.

5. The embroidery machine according to claim 4, wherein the stroke of the miniature pneumatic cylinder can be adjusted axially in order to move the piercer to the required different penetration depth into the embroidery fabric.

6. The embroidery machine according to claim 5, and a control lever (72) is provided in contact with a cylinder (65) for actuating the piercer and said lever (72) determines the required position of said cylinder by control means (74).

7. The embroidery machine according to claim 2 wherein said elements are arranged so that their width can be selectively adjusted.

8. The embroidery machine according to claim 1 wherein each individual head has an accommodating housing (35,36) on which additional elements (33, 34, 76, 77) can be mounted in modular form to extend the embroidery programs and designs.

9. The embroidery machine according to claim 1 wherein needle bars (20) are provided, and said mechanical driving means (3, 21, 22, 23, 24, 39) drive the needle bars (20) of said individual heads (1,2) with continuous movements that are oscillating and linear.

10. The embroidery machine according to claim 9 wherein the needle bar drives can be coupled and decoupled in groups or independently from the opposite head.

11. The embroidery machine according to claim 1 wherein said driving means include two actuating shafts (53,54) which are independent of each other and which can be optionally coupled to each other.

12. The embroidery machine according to claim 1 and follower pins (57,58) and wherein said driving means include two preprogrammed control shafts (59,60) which are independent of each other on said follower pins, said control shafts being adapted to control needle bar actuating shafts (53,54) according to a selected program.

13. The embroidery machine according to claim 1 including means (35,36,76,77) for extending the horizontal basic needle interval in steps.

14. The embroidery machine according to claim 1 wherein a needle bar (20) is connected with a toothed rack (24) via a latch (25) and a coupling piece (26) whereby said needle bar can be detached.

15. The embroidery machine according to claim 1 and a driving rocker shaft (3) mounted in bearings in such a manner that an individual head (1) can be removed therefrom in a radial direction.

16. The embroidery machine according to claim 15 wherein the rocker shaft (3) is mounted in a semicircular bearing sleeve (27) which is arranged in the individual head housing in such a manner that a bearing gap (38) is formed through which the individual head can be removed in a radial direction from the rocker shaft, and a clamping piece (30) for securing said bearing sleeve.

17. The embroidery machine according to claim 16, wherein said drive means (21,32) are pinions, and pinion (32) is fastened outside the individual head on shaft (3).

18. The embroidery machine according to claim 1, and needle bars 20 having toothed racks 24, and a shaft (40) for carrying driving wheels (23,39) which engage with the toothed racks (24) of the needle bars, said shaft (40) is mounted for axial displacement, and locking means (24') for effecting different locking positions by mutually engaging the driving wheels and the toothed racks.

19. The embroidery machine according to claim 1 wherein the actuating elements (43) are arranged to act together with shaft (40) in such a manner that the gear wheels (23,39) of corresponding individual heads (1,2) can be brought out of engagement with the driving wheels but they remain in engagement with their needle bar toothed rack (24).

20. The embroidery machine according to claim 19, wherein a single actuating shaft (48) is provided for both individual heads (1,2).

21. The embroidery machine according to claim 19, wherein each individual head (1,2) is provided with its own actuating shaft (53,54) with follower pins (57,58).

22. The embroidery machine according to claim 21, wherein each actuating shaft (53,54), has a control shaft (59,60).

23. The embroidery machine according to claim 1, wherein a needle bar (20) is provided with a twin needle head (80) and two yarn tubes (91,92) for guiding the needle yarn (87,88) to yarn guiding holes (93,94), said tubes being fastened on said head (80).

24. The embroidery machine according to claim 1, wherein the front yarn knife is accommodated within the housing of the embroidery head.

25. The embroidery machine according to claim 1, wherein the drive (147,148) for needles (151,152) and the drive (126,127) for piercers (140,141) are actuated by a common drive arrangement (145).

26. The embroidery machine according to claim 25, wherein the needles, piercers and yarn clamping-cutting arrangements are actuated by the common drive arrangement (145).

27. The embroidery machine according to claim 26, wherein the drive arrangement (145) is powered by a step motor.

28. The embroidery machine according to claim 27, wherein the coupling and decoupling of said elements is carried out by means of control shafts (163,164) which can be rotated and moved axially.

29. The embroidery machine according to claim 28, wherein the actuating shafts (163,164) are associated with further actuating shafts.

30. Embroidery machine according to claim 27, wherein the coupling and decoupling of said elements is carried out by means of an electronic program arrangement.

31. The embroidery machine according to claim 25, wherein the drive arrangement (145) is a toothed continuous shaft.

32. The embroidery machine according to claim 31, wherein the needle and piercer units are held in their initial positions by blocking elements (165 to 169), which can be brought into locking engagement with matching elements in the individual heads.

33. The embroidery machine according to claim 32, wherein the blocking elements (165–169) are toothed elements which are mounted in such a manner in the actuating bearing blocks (155,156) of the individual heads that their height can be adjusted.

* * * * *